US007318286B1

(12) United States Patent
Willette et al.

(10) Patent No.: US 7,318,286 B1
(45) Date of Patent: Jan. 15, 2008

(54) APPARATUS AND PROCESS FOR DETERMINING LUMBAR CONFIGURATION IN A CHAIR

(75) Inventors: Joe Willette, Grand Haven, MI (US); Larry A. Wilkerson, Comstock Park, MI (US); Teresa Bellingar, Holland, MI (US)

(73) Assignee: Haworth, Inc., Holland, MI (US)

( * ) Notice: Subject to any disclaimer, the term of this patent is extended or adjusted under 35 U.S.C. 154(b) by 12 days.

(21) Appl. No.: 11/450,907

(22) Filed: Jun. 9, 2006

Related U.S. Application Data

(60) Provisional application No. 60/689,780, filed on Jun. 10, 2005.

(51) Int. Cl.
*G01B 5/20* (2006.01)

(52) U.S. Cl. ..... 33/561.1; 33/514.2; 33/512

(58) Field of Classification Search ..... 33/561.1, 33/1 BB, 512, 514.2, 515, 549, 551, 552, 33/555

See application file for complete search history.

(56) References Cited

U.S. PATENT DOCUMENTS

| | | | | |
|---|---|---|---|---|
| 889,224 | A | 6/1908 | Haas | |
| 2,301,841 | A * | 11/1942 | Zeder | 33/561.1 |
| 2,378,039 | A * | 6/1945 | Schenker | 33/514.2 |
| 3,081,129 | A | 3/1963 | Ridder | |
| 3,288,525 | A | 11/1966 | Cerf | |
| 4,309,058 | A | 1/1982 | Barley | |
| 4,465,317 | A | 8/1984 | Schwarz | |
| 4,744,351 | A | 5/1988 | Grundei et al. | |
| 4,876,758 | A * | 10/1989 | Rolloff et al. | 33/551 |
| 4,993,164 | A | 2/1991 | Jacobsen | |
| 4,998,354 | A * | 3/1991 | Silverman et al. | 33/514.2 |
| 6,217,121 | B1 | 4/2001 | Mollet | |
| 6,394,545 | B2 | 5/2002 | Knoblock et al. | |
| 6,460,928 | B2 | 10/2002 | Knoblock et al. | |
| 6,595,585 | B2 | 7/2003 | Mundell | |
| 6,616,228 | B2 | 9/2003 | Heidmann | |
| 6,623,076 | B2 | 9/2003 | Klingler | |
| 6,666,511 | B2 | 12/2003 | Schuster et al. | |
| 2003/0075959 | A1 | 4/2003 | Xue et al. | |
| 2003/0164634 | A1 | 9/2003 | Da Silva | |
| 2003/0227203 | A1 | 12/2003 | Mundell | |

FOREIGN PATENT DOCUMENTS

| | | |
|---|---|---|
| EP | 0 296 938 B1 | 6/1991 |

* cited by examiner

*Primary Examiner*—Christopher W Fulton
(74) *Attorney, Agent, or Firm*—Flynn, Thiel, Boutell & Tanis, P.C.

(57) ABSTRACT

An office chair is provided having a back assembly which is configured to provide supplemental support to the back of a chair occupant in addition to the support provided by the primary support surface of the chair back. The chair back includes a lumbar support unit having a lumbar support pad wherein asymmetric support is provided to the left and right halves of the lumbar pad. As such, the asymmetric support loads are independently adjustable to more comfortably support a chair occupant. A testing apparatus and method are used to optimize the support pressure characteristics of the lumbar pad.

20 Claims, 17 Drawing Sheets

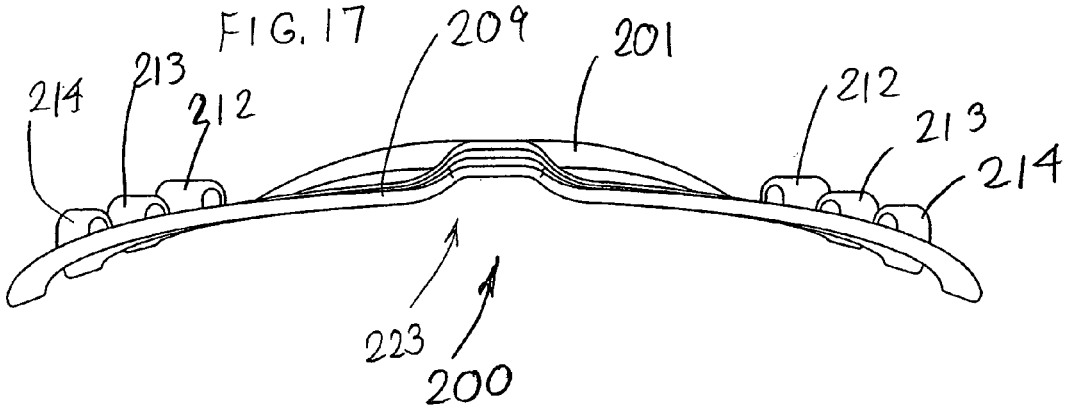
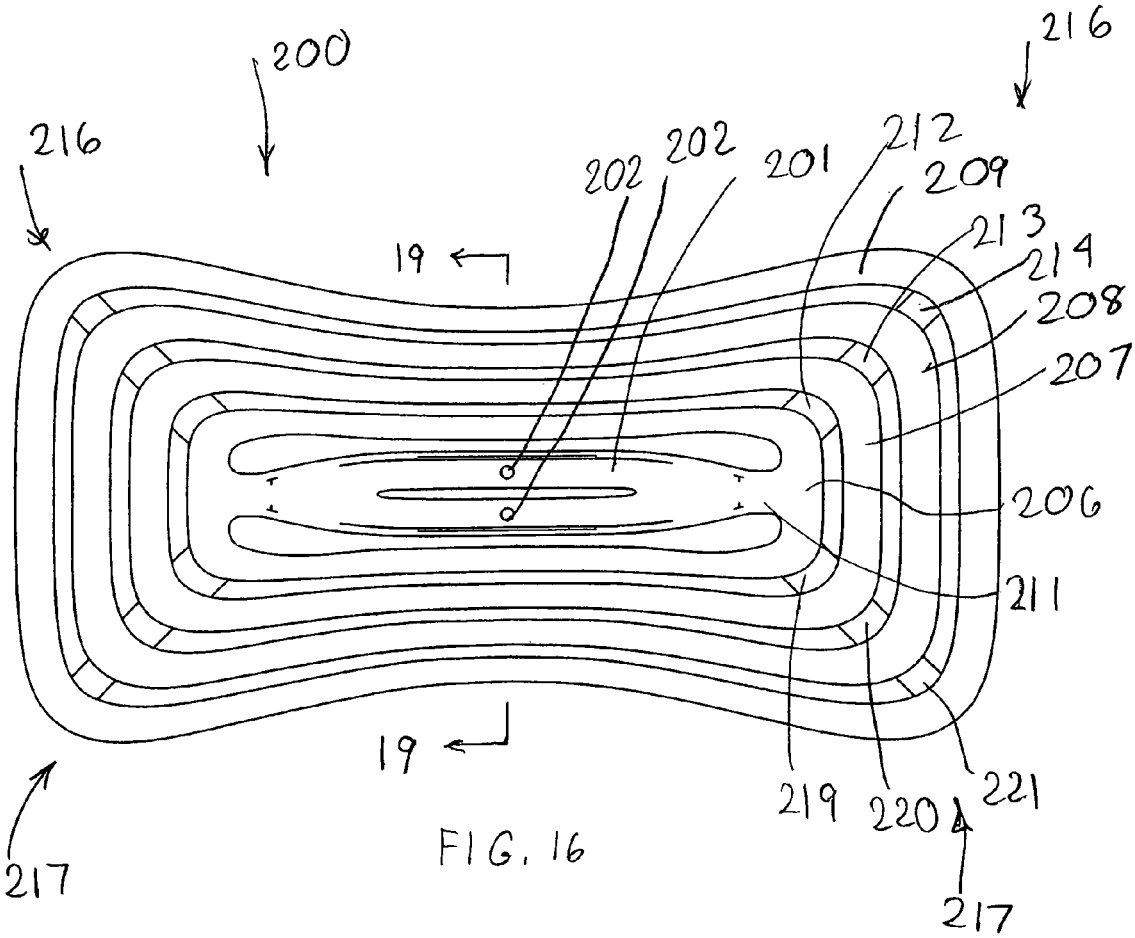
FIG. 16

APPARATUS AND PROCESS FOR DETERMINING LUMBAR CONFIGURATION IN A CHAIR

CROSS REFERENCE TO RELATED APPLICATIONS

This application claims the benefit of U.S. Provisional Application Ser. No. 60/689,780, filed Jun. 10, 2005, which is incorporated herein by reference in its entirety.

FIELD OF THE INVENTION

The invention relates to the development of a body support element for an office chair and more particularly, to the apparatus and process for determining the configuration of a lumbar support pad for the office chair to support the back of the chair occupant.

BACKGROUND OF THE INVENTION

Preferably, conventional office chairs are designed to provide significant levels of comfort and adjustability. Such chairs typically include a base which supports a tilt control mechanism to which a seat assembly and back assembly are movably interconnected. The tilt control mechanism includes a back upright which extends rearwardly and upwardly and supports the back assembly rearwardly adjacent to the seat assembly. The tilt control mechanism serves to interconnect the seat and back assembly so that they may tilt rearwardly together in response to movements by the chair occupant, and possibly to permit limited forward tilting of the seat and back. Further, such chairs typically permit the back to also move relative to the seat during such rearward tilting.

The chair also is designed to provide additional support assemblies to provide further support to the occupant's body at various locations thereof. In this regard, support assemblies have been provided which attempt to provide adjustable support to the lower back of the user in the lumbar region thereof. However, one difficulty associated with the design of conventional office chairs is the fact that office workers have different physical characteristics and comfort preferences such that it is difficult to design a single chair configuration that satisfies the preferences of the different individuals who might purchase such a chair.

To improve comfort, it is known to provide lumbar supports which allow for adjustment of the elevation of the lumbar support along the back of the user. However, often times, such lumbar supports may be found uncomfortable to various individuals since they tend to provide localized pressure on the lumbar region of the back.

Accordingly, it is an object of the invention to overcome disadvantages associated with prior lumbar support arrangements and to develop a lumbar support using test data that represents the actual, quantifiable comfort preferences of a group of test occupants.

The invention relates to a chair having an improved back assembly which provides support to the back region of the chair occupant. The back assembly of the invention includes a lumbar support arrangement preferably disposed in the lumbar region of the back which is adjustable vertically to accommodate different sizes of chair users.

The back assembly is of the type having an open annular frame with a suspension fabric extending therebetween to close the central opening of the back frame. Since this suspension fabric is only a thin layer of material, the support provided by the lumbar support assembly is more readily felt and it is more critical to provide a comfortable lumbar support pad.

In an effort to provide optimum support to the back of the chair occupant, the lumbar support pad itself is formed of concentric support rings wherein radially adjacent pairs of such rings are flexibly joined together by connector webs extending therebetween. To a certain extent, each ring can independently move or is at least supported independently relative to an adjacent ring. This allows for greater variations in support pressure being applied by each ring to the back of the occupant, and the lumbar support pad more readily adjusts to the shape of the occupant's back. The support pad therefore provides an adjustable and optimized amount of asymmetric support pressure while maintaining a proper ergonomic posture to the seated occupant. Further, the selected locations of the connector webs provides support to areas of the pad that have been determined to be most preferable as a result of the test apparatus and method of the invention.

Additionally, the lumbar support pad is carried by a support arm formed similar to a leaf spring wherein the support arm has a vertically elongate opening in the middle thereof to separate the left and right halves of the support arm from each other along a substantial portion of the length of each support arm. While the support arm may bend rearwardly in response to the occupant or at least resiliently resist such movement, the bending point for each of the left and right halves is independently adjustable so that the support provided to the lumbar support pad is asymmetric with respect to the left and right halves of the support pad. This support arm provides asymmetric support to the lumbar support pad and each half thereof provides support pressures which are more independent of the other. The chair occupant therefore can more accurately adjust the support provided by the support pad asymmetrically wherein it has been found through testing that this asymmetric support provides improved comfort to the chair occupant.

The invention further relates to the test apparatus and process for determining the optimum design of the lumbar pad. The test apparatus includes a test rig on a chair which determines the contour and pressure map of the lumbar support preferred by the occupant when seated.

The test rig has a support plate rearwardly of and facing toward the lumbar area of the occupant's back. The support plate includes an array of adjustable testers which project toward and contact the occupant's lumbar area. The preferred testers are arranged in a rectangular grid pattern of rows and columns and include a plunger like contact pad. The pad is spring-loaded and supported on a plunger rod. The plunger rod is attached on the support plate and movable relative thereto to adjust the resiliently biased pressure being applied by the contact pad to the lumbar area. An FSA pressure mapping system is further used to verify and quantify the pressure being applied to the lumbar.

As a result of this pressure mapping testing process, the above-described lumbar pad was developed to provide optimum support to the occupant. It will be understood that the test process was primarily directed to development of the lumbar pad although other support pads or structures in the back and/or seat could be developed through the test apparatus and process of the invention.

Other objects and purposes of the invention, and variations thereof, will be apparent upon reading the following specification and inspecting the accompanying drawings.

BRIEF DESCRIPTION OF THE DRAWINGS

FIG. 16 is a front view of a second embodiment of a lumbar support pad.

FIG. 17 is a top view thereof.

Figure 2:
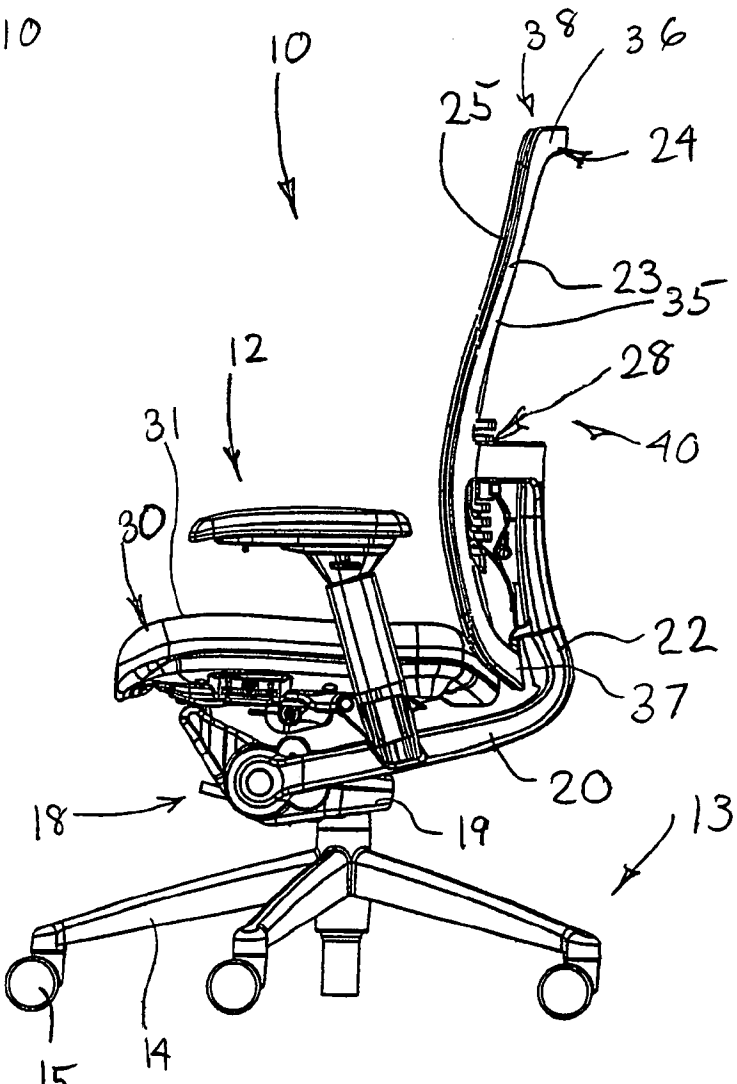
FIG. 2 is a side elevational view thereof.
Figure 1:
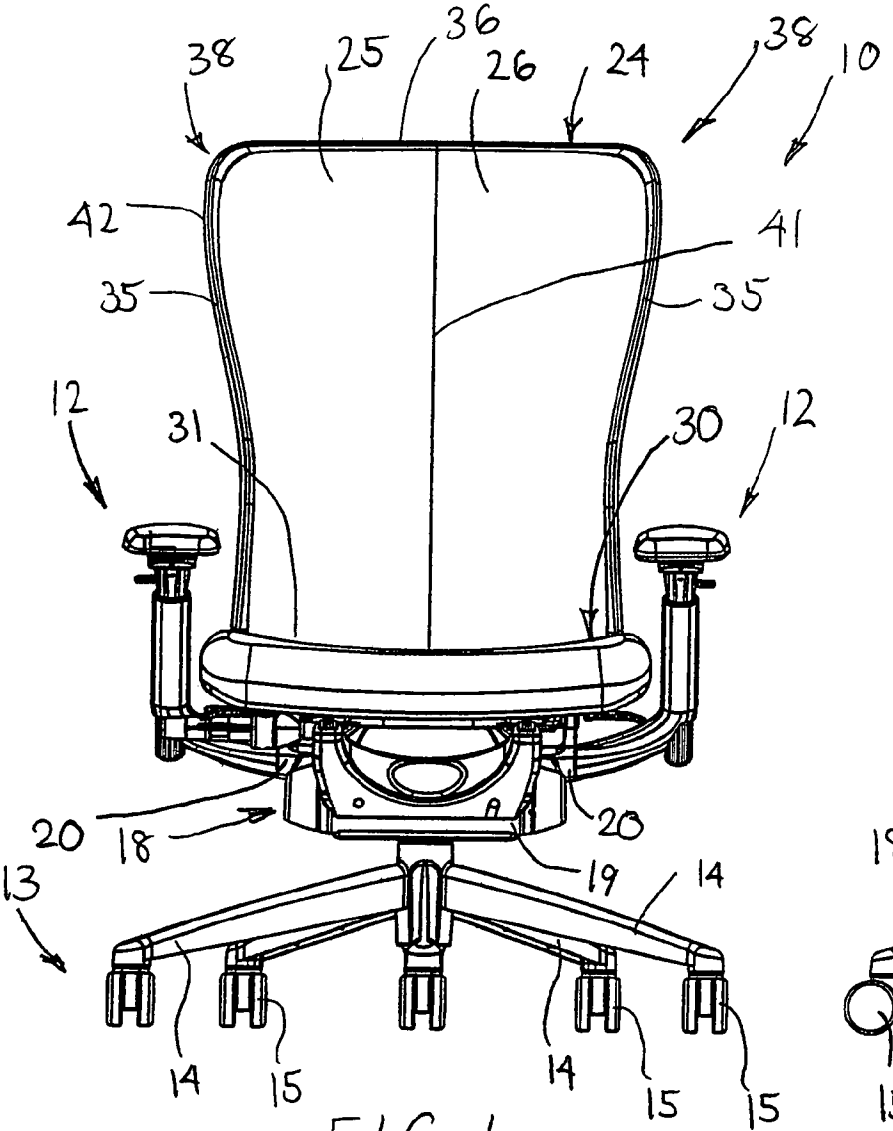
FIG. 1 is a front elevational view of an office chair of the invention.
Figure 4:
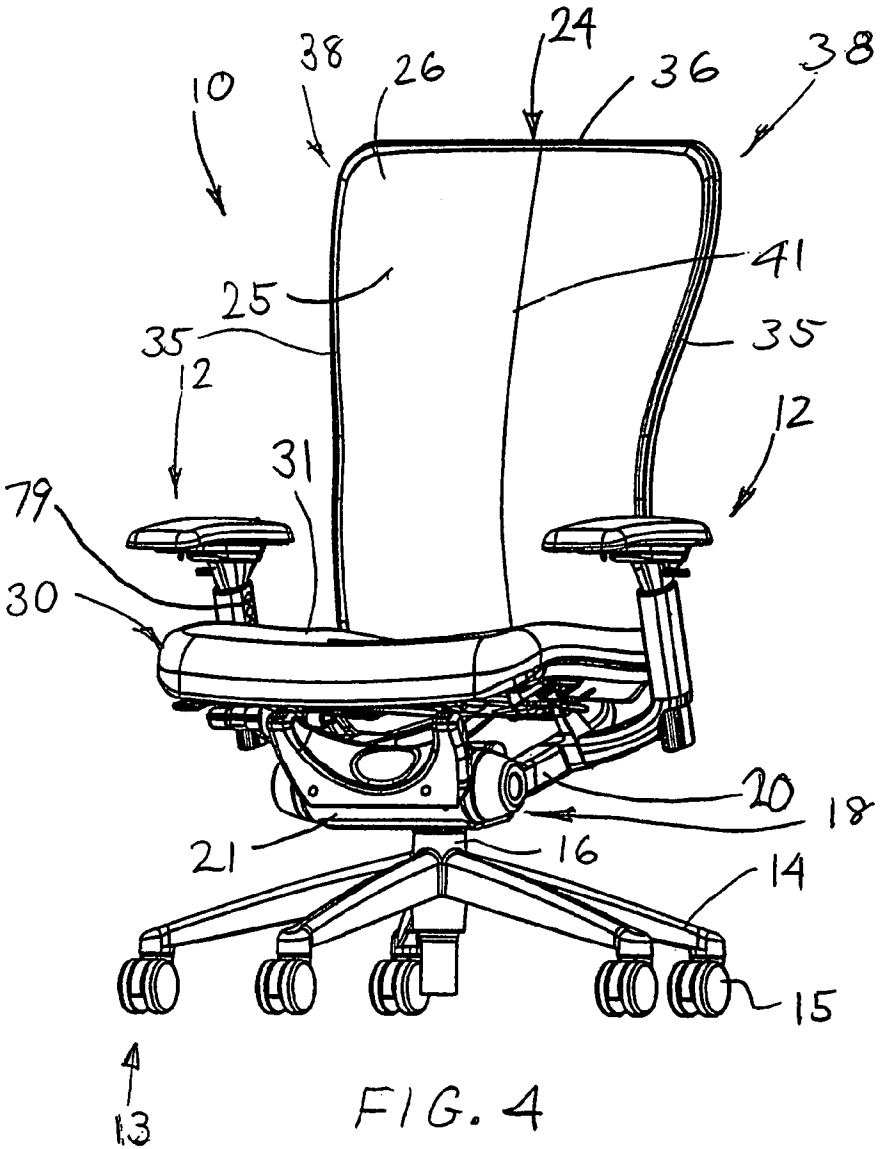
FIG. 4 is a front isometric view of the chair.
Figure 3:
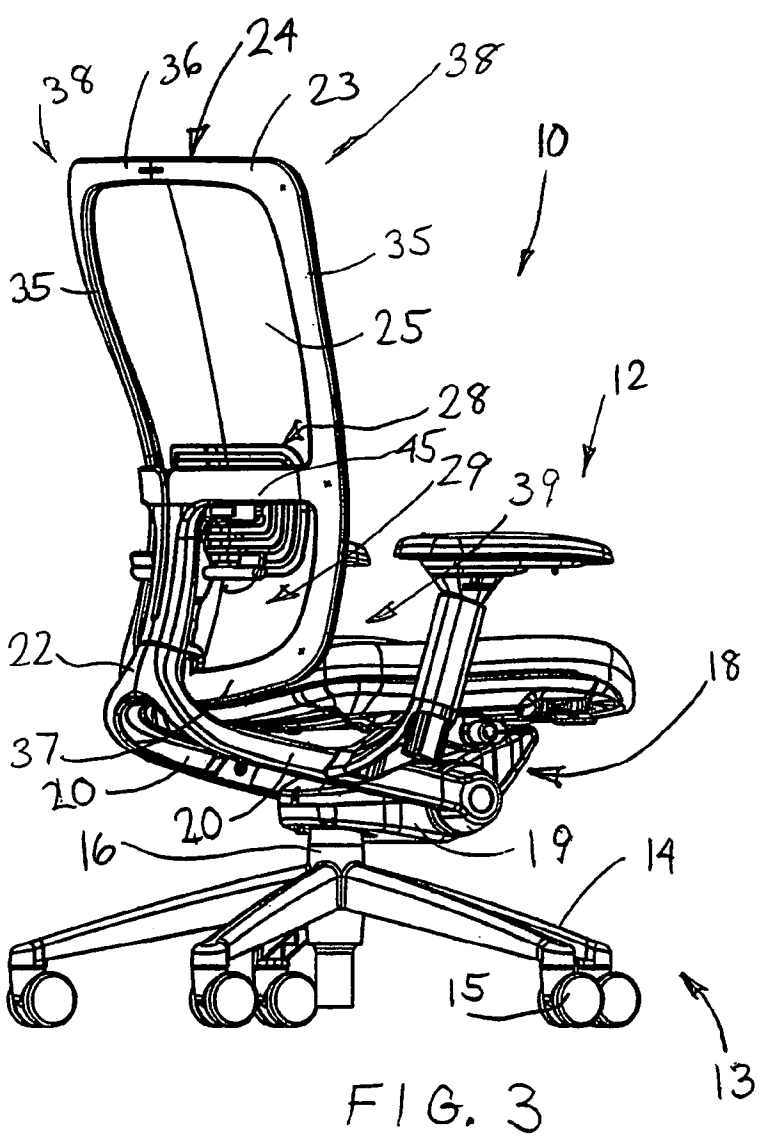
FIG. 3 is a rear isometric view thereof illustrating lumbar and pelvic support units therefor.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIGS. 1-4, the invention generally relates to an office chair 10 which includes various inventive features therein that accommodates the different physical characteristics and comfort preferences of a chair occupant and also improve assembly of the chair 10.

Generally, this chair 10 includes improved height-adjustable arm assemblies 12 which are readily adjustable. The structure of each arm assembly 12 is disclosed in U.S. Patent Application Ser. No. 60/657,632, entitled ARM ASSEMBLY FOR A CHAIR, which is owned by Haworth, Inc., the common assignee of this present invention. The disclosure of this patent application is incorporated herein in its entirety by reference.

The chair 10 is supported on a base 13 having radiating legs 14 which are supported on the floor by casters 15. The base 13 further includes an upright pedestal 16 which projects vertically and supports a tilt control mechanism 18 on the upper end thereof. The pedestal 16 has a pneumatic cylinder therein which permits adjustment of the height or elevation of the tilt control mechanism 18 relative to a floor.

The tilt control mechanism 18 includes a control body 19 on which a pair of generally L-shaped uprights 20 are pivotally supported by their front ends. The uprights 20 converge rearwardly together to define a connector hub 22 (FIG. 3) on which is supported the back frame 23 of a back assembly 24. The structure of this tilt control mechanism 18 is disclosed in U.S. Patent Application Ser. No. 60/657,541, entitled TILT CONTROL MECHANISM FOR A CHAIR, and U.S. Patent Application Ser. No. 60/657,524, entitled TENSION ADJUSTMENT MECHANISM FOR A CHAIR, which applications are owned by Haworth, Inc. The disclosure of each of these patent applications is incorporated herein in their entirety by reference.

The back assembly 24 has a suspension fabric 25 supported about its periphery on the corresponding periphery of the frame 23 to define a suspension surface 26 against which the back of a chair occupant is supported. The structure of one back assembly 24 is disclosed in U.S. Patent Application Ser. No. 60/657,313, entitled CHAIR BACK, which is owned by Haworth, Inc. The disclosure of this patent application is incorporated herein by reference.

To provide additional support to the occupant, the back assembly 24 includes a lumbar support unit 28 which is configured to support the lumbar region of the occupant's back and is adjustable to improve the comfort of this support. Also, the back assembly 24 is provided with a pelvic support unit 29 disposed rearwardly of the pelvic region of the chair occupant. This back arrangement is disclosed in further detail in U.S. Patent Application Ser. No. 60/657,312, entitled CHAIR BACK WITH LUMBAR AND PELVIC SUPPORTS, which is owned by Haworth, Inc. The disclosure thereof is incorporated herein by reference.

Additionally, the chair 10 includes a seat assembly 30 that defines an upward facing support surface 31 on which the seat of the occupant is supported.

Figure 5:
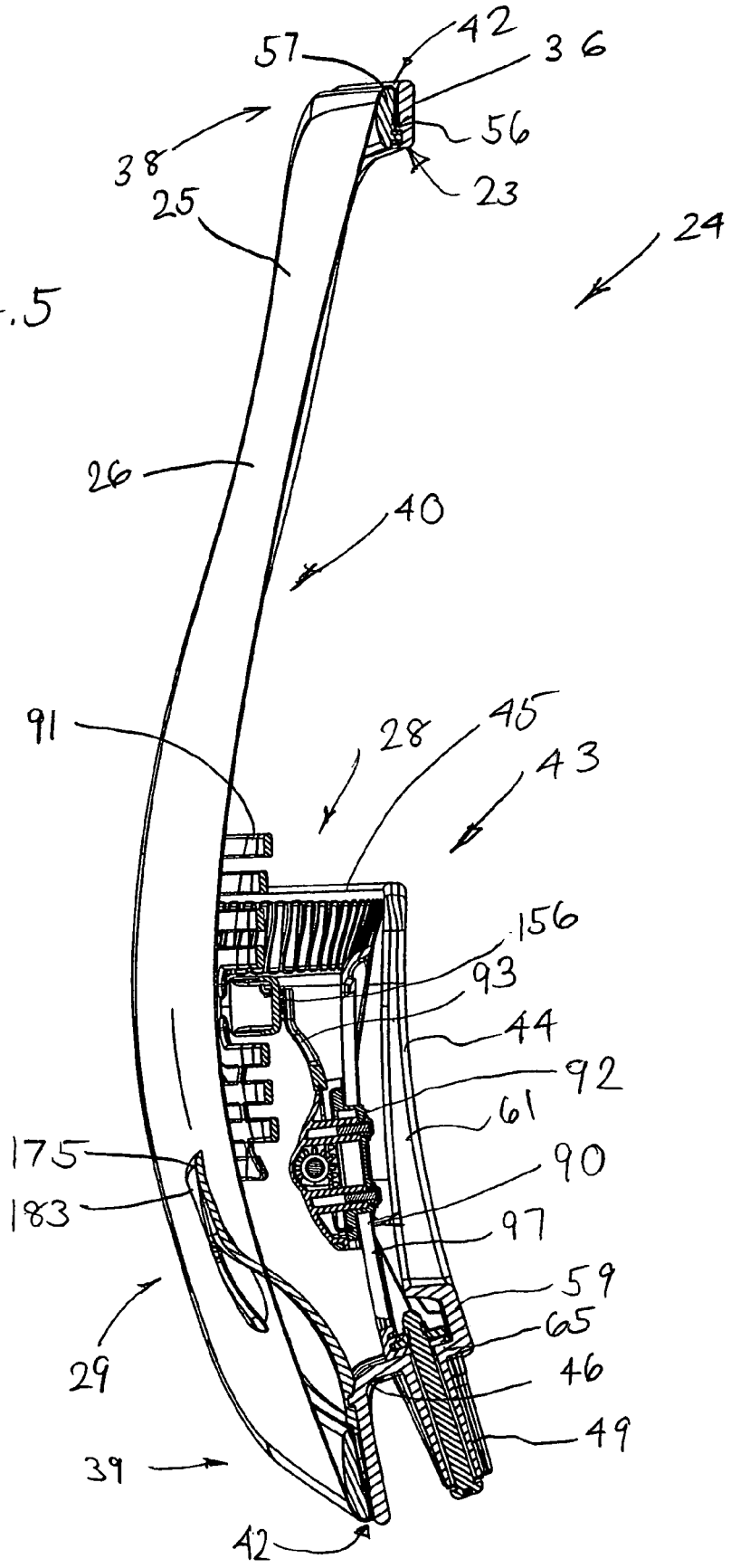
FIG. 5 is a side cross-sectional view of a chair back assembly illustrating the lumbar and pelvic support units.
Figure 6:
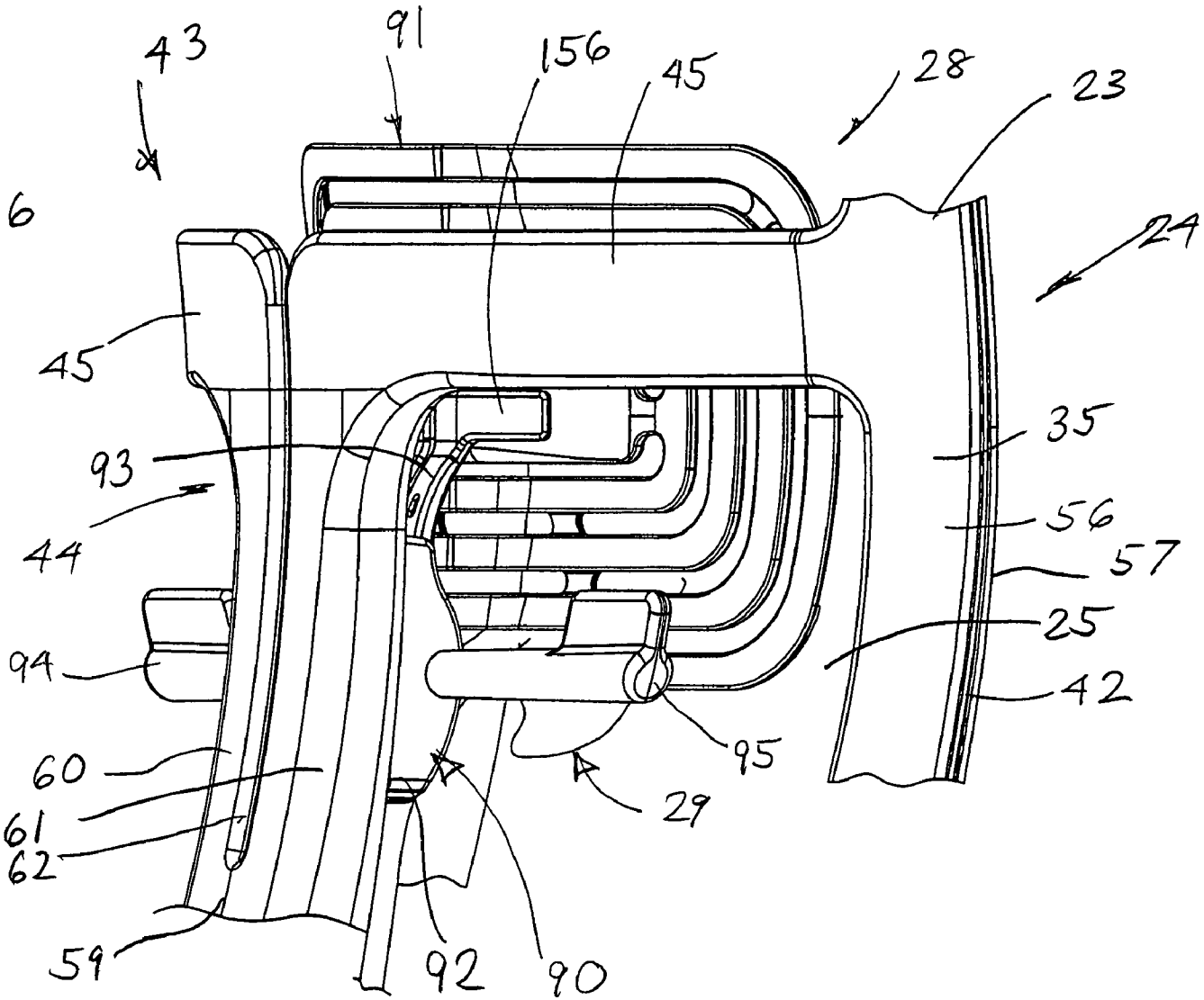
FIG. 6 is an enlarged rear isometric view of the back assembly.
Figure 7:
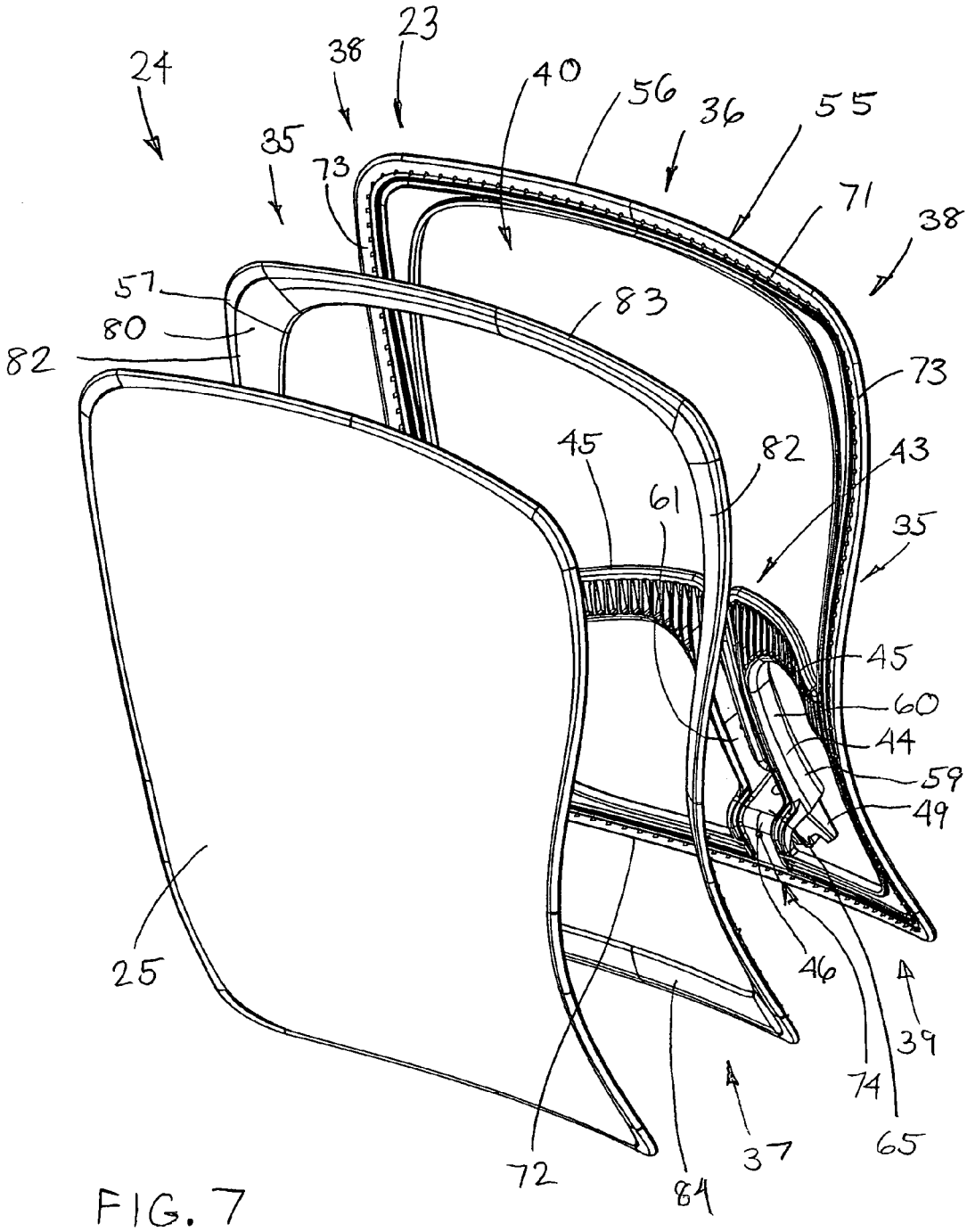
FIG. 7 is an exploded isometric view of the back frame for the back assembly.

Turning first to the back assembly 24 which supports the lumbar support unit 28 and the pelvic support unit 29, the back assembly 24 is generally illustrated in FIGS. 5-8 wherein the back frame 23 comprises a pair of vertical side frame rails 35, a top frame rail 36, and a bottom frame rail 37 which are joined together at the upper corners 38 of the back assembly 24 as well as the lower corners 39 to define an annular or endless frame having a central opening 40. As can be seen in FIGS. 5-7, the back frame 23 has a contoured shape which ergonomically supports the back of the occupant.

To support the occupant, the back assembly 24 includes the suspension fabric 25 which is secured taughtly on the frame. Specifically, the back frame 23 includes a peripheral channel 42 (FIGS. 1, 5 and 6), in which is fixed the peripheral edge of the suspension fabric 25.

Referring further to FIGS. 5-7, the back frame 23 generally includes a support structure 43 to which the side rails 35 and bottom rail 37 are rigidly interconnected. This support structure 43 comprises an upright support column 44 which extends along the chair center line 41 (FIG. 1) to an elevation located just below the middle of the side rails 35. The upper end of the support column includes a pair of horizontal support arms 45 which extend sidewardly and have each respective outer end connected rigidly to one of the side rails 35.

The lower end of the support column 44 includes a generally L-shaped connector flange 46 (FIGS. 5 and 7) which projects forwardly and then downwardly into fixed engagement with the lower cross rail 37. Still further, this lower column end includes a bayonet connector 49 which projects downwardly for rigid connection to the uprights 20 by a fastener bolt 50 (FIG. 8) and nut 51.

Referring more particularly to the components of the back assembly 24, FIG. 7 illustrates these components in an exploded view thereof, wherein the frame 23 comprises a rear frame unit 55 which includes the support structure 43 described above as well as a rear frame ring 56 which is supported on the support arms 45 of the support structure 44. The back frame 24 further comprises a front frame ring 57 which is adapted to be mounted to the rear ring 56 in overlying relation to define the channel 42 about the periphery thereof. Further, the back assembly 24 includes the above-described suspension fabric 25 which preferably is secured to the rear ring 56 by ultrasonic welding or alternatively, by an elastomeric spline 58 (not illustrated herein).

The rear frame unit 55 comprises the support structure 43 and the rear frame ring 56, wherein the support structure 43 and the rear frame ring 56 are molded simultaneously together in a one-piece monolithic construction having the contoured shape described above. To facilitate molding of this contoured shape while still possessing the channel 42 mentioned above, the rear frame ring 56 and front frame ring 57 are molded separate from each other and then affixed together.

Turning to the support structure 43, the support column 44 thereof is located centrally within the lower half of the central frame opening 40. The support column 44 has a base end 59 and a pair of column halves 60 and 61 which are separated from each other by a vertically elongate column slot 62 (FIG. 6). The column 44 therefore is formed as a split column by the slot 62 which extends along a substantial portion of the length of the column 44 with the column halves 60 and 61 being formed at their base end as one piece along with the base section 59. As such, the column halves 60 and 61 are supported in cantilevered relation by the base section 59.

The rear frame unit 55 and front frame ring 57 are formed from a glass filled nylon material that is molded into the desired shapes wherein this material has limited flexure so as to permit flexing of the various areas of the frame when placed under load by a chair occupant. Since the column halves 60 and 61 are separated from each other, these column halves 60 and 61 may articulate independently of each other to facilitate flexing and movement of the various frame corners 38 and 39. The upper ends of the frame halves 60 and 61 join integrally to the transverse arms 45, wherein the outer ends of the arms 45 extend outwardly and are molded integral with the vertical sides of the rear frame ring 56.

Figure 8:
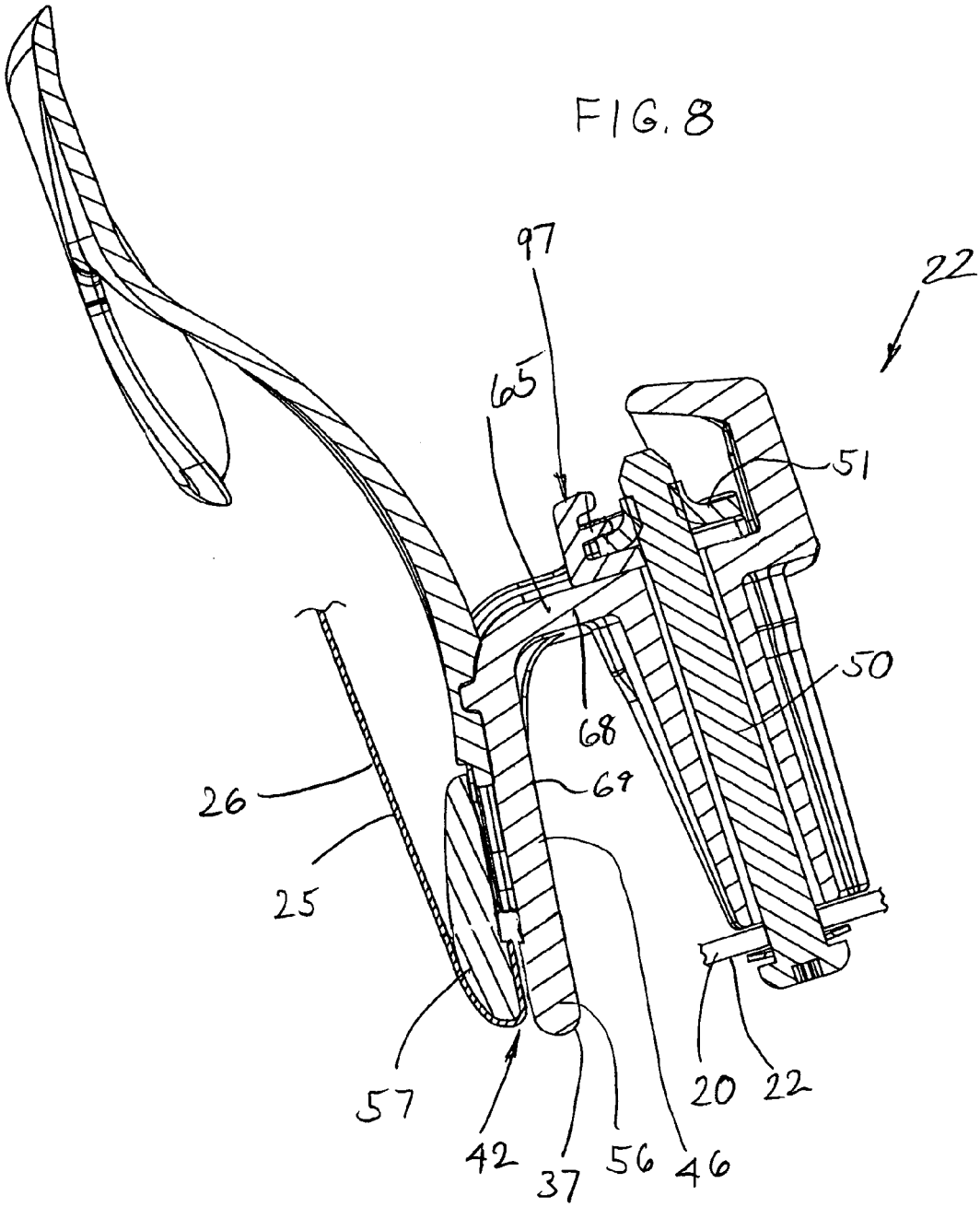
FIG. 8 is an enlarged side cross-sectional view of a bayonet connector arrangement for mounting the back assembly to a tilt control mechanism with the pelvic support unit or pusher illustrated therein.

In the column base 59, this column base 59 terminates at a bottom wall 65 (FIGS. 5, 7 and 8), which is formed with a bore 66 extending vertically therethrough. The bottom wall 65 further is formed integral with the bayonet connector 49 wherein the bore 66 extends vertically through this bottom wall 65 and the bayonet connector 49 as seen in FIG. 8. When joining the back frame 23 to the chair uprights 20, the fastener 50 extends upwardly from the uprights 20 as will be described in further detail herein and then extends through the fastener bore 66 so that it projects vertically above the bottom column wall 65. The upper end of the fastener 50 is threadedly engaged by the nut 51 as seen in FIG. 8 to thereby secure the back frame 23 to the uprights 20.

Further as to the bottom column wall 65 as seen in FIG. 8, this wall 65 extends forwardly to define a horizontal leg 68 of the L-shaped flange 46, which flange 46 then turns downwardly to define a vertical leg 69. The bottom column section 59 therefore serves to rigidly support the bottom cross rail 37 of the back frame 23.

Figure 26:
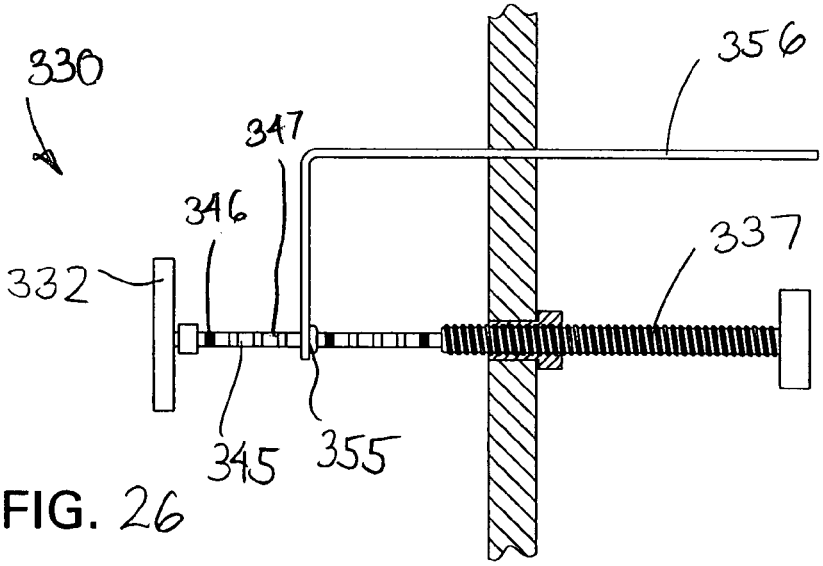
FIG. 26 illustrates the tester returned to an initial position with the marker in the position depicted in FIG. 25.

Referring to FIG. 7, the rear frame ring 56 comprises top and bottom ring sections 71 and 72 and left and right ring sections 73 which extend vertically. In the middle of the lower ring section 72 as seen in FIGS. 7 and 26, a recessed pocket 74 is defined which opens upwardly and supports the pelvic support unit 29.

As to the front frame ring 57 (FIG. 7), this frame ring has a front face 80 which faces forwardly and a rear face 81 which faces rearwardly towards the rear frame ring 56 and is adapted to abut thereagainst and be fixedly secured thereto by ultrasonic welding. This frame ring 57 is defined by vertical ring sections 82 and a top ring section 83 and a bottom ring section 84. When joined together, the front frame ring 57 and rear frame unit 55 define the back frame 23.

Turning next to the lumbar support unit 28, this unit is generally illustrated in FIGS. 5 and 6 and includes an adjustment assembly 90 which projects upwardly from the bottom of the back frame 23 and supports a lumbar support pad 91 on the upper end thereof. The adjustment assembly 90 includes a carriage 92 which is vertically movable to adjust the elevation of the lumbar pad 91 and in particular, allow the occupant to adjust the height of the pad 91 to a location along the vertical height of the occupant's back which is most comfortable.

The carriage supports a resilient support arm 93 that effectively serves as a leaf spring so that the lumbar pad 91 may float rearwardly in response to movements of the occupant. Further, the support arm 93 provides asymmetric support to the lumbar pad 91 such that one-half of the lumbar pad 91 may apply less support pressure to the occupant as compared to the other half of the lumbar pad 91 which may provide firmer support. The asymmetric support pressures of the lumbar pad 91 is adjustable by a pair of adjustment cranks 94 and 95 (FIG. 6). The cranks 94 and 95 are rotatable independently of each other to independently set the support level provided to the left and right halves of the lumbar pad 91 by the support arm 93 whereby the adjustment of the support does not require a mechanical translation of the pad position.

Figure 9:
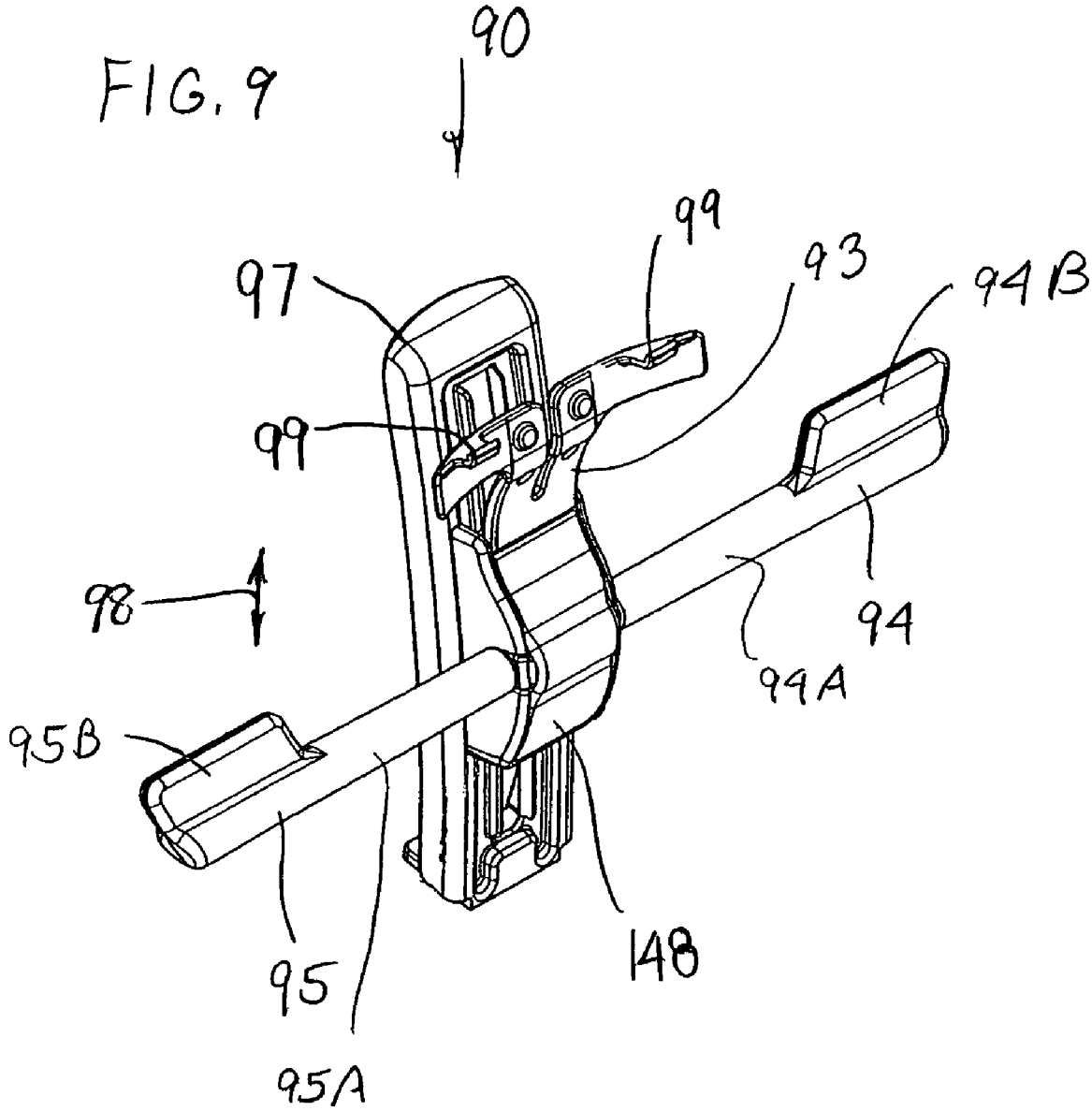
FIG. 9 is an isometric view of an adjustment assembly for the lumbar support unit.
Figure 10:
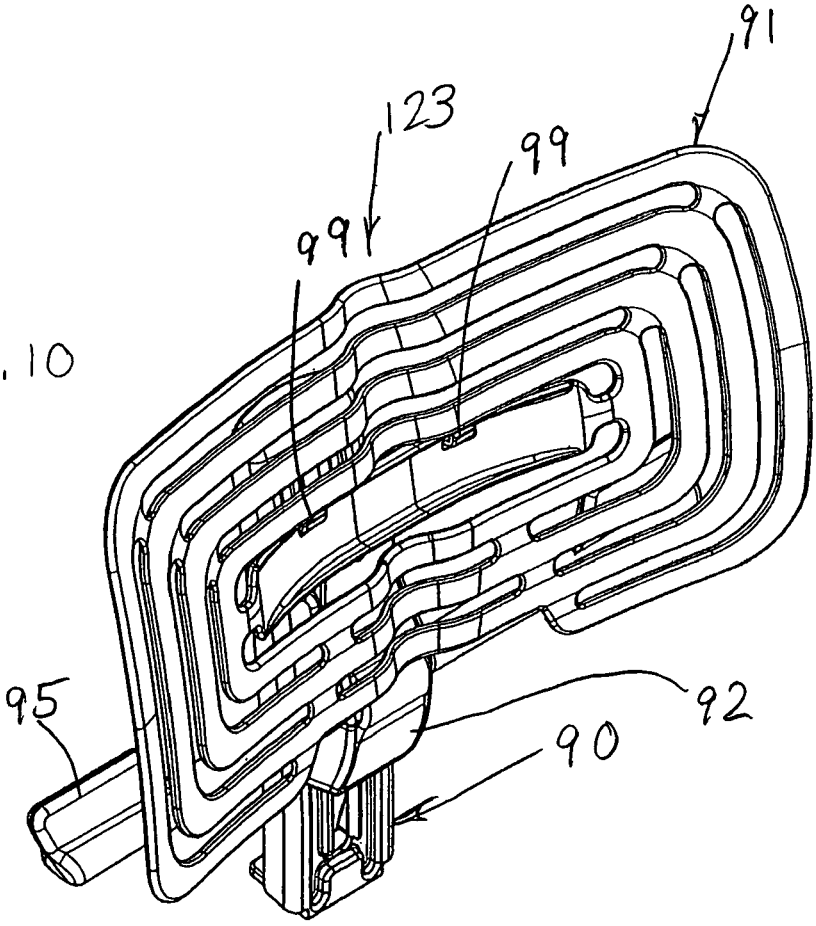
FIG. 10 is an isometric view of the lumbar support unit having a lumbar pad mounted on the adjustment assembly.

Referring to FIG. 9, the adjustment assembly 90 generally comprises a vertical support bracket 97 which is adapted to support the carriage 92 such that it is movable vertically as generally indicated by reference arrow 98 (FIG. 9). This carriage 92 has the resilient support arm 93 carried thereon so as to project upwardly therefrom wherein the upper edge of the support arm 93 includes a pair of hooks 99 that support the lumbar pad 91 as indicated in FIG. 10.

Referring to FIGS. 11-15, the lumbar pad 91 has an inventive construction which provides additional levels of comfort and conformability in addition to the advantages provided by the adjustment assembly 90. More particularly as to this lumbar pad 91, the pad 91 is molded of a plastic material, preferably PTEG copolyester which provides a suitable level of resilient flexibility. As will be described herein, the lumbar pad 91 has a generally rectangular shape that is defined by concentric support rings 106-109 that are radially spaced apart from each other.

Figure 15:
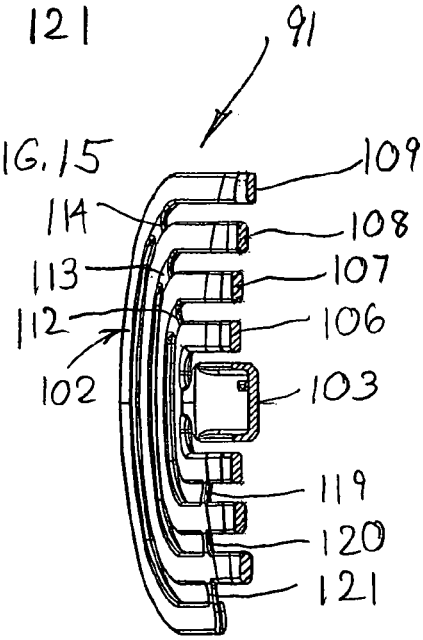
FIG. 15 is a side cross-sectional view of the lumbar pad as taken along line 15-15 of FIG. 12.
Figure 19:
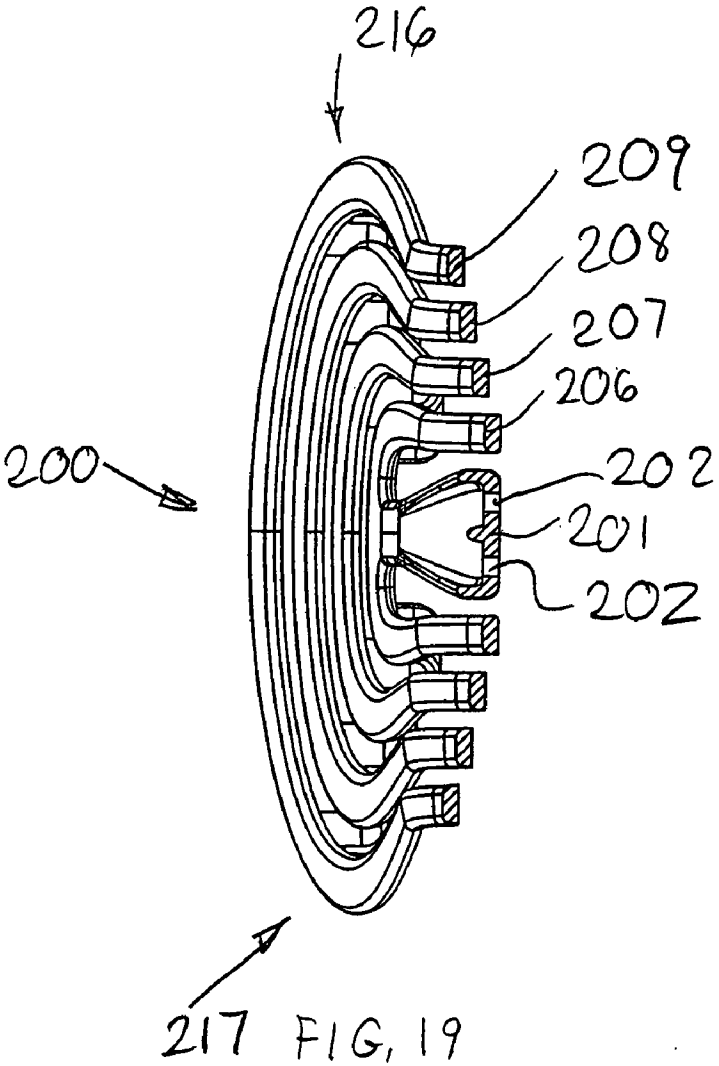
FIG. 19 is a side cross-sectional view of the lumbar support pad as taken along line 19-19 of FIG. 16.
Figure 18:
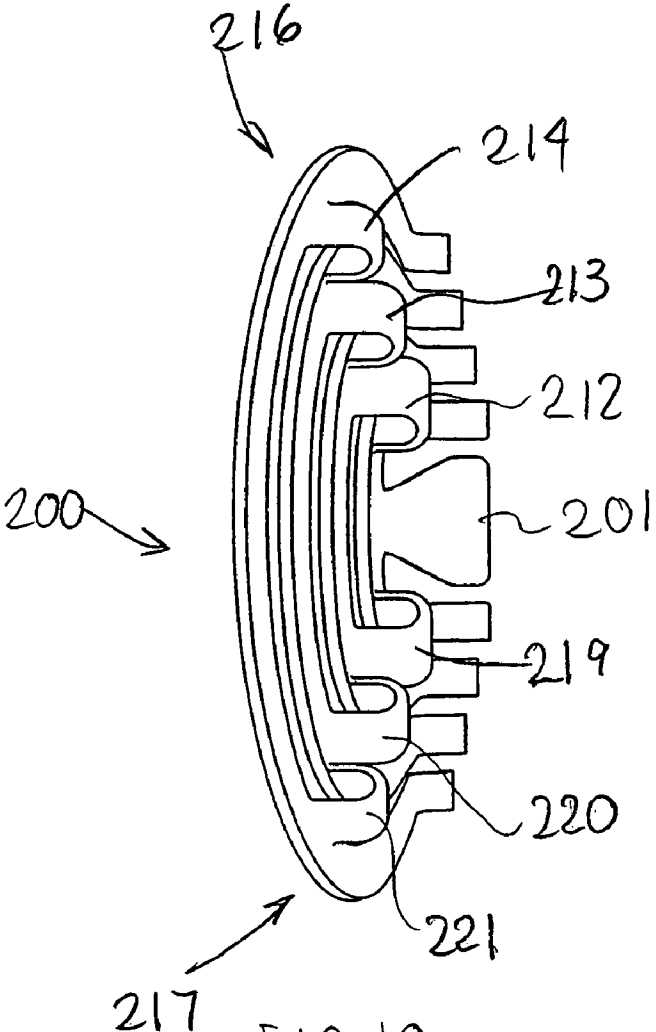
FIG. 18 is a side view thereof.

More particularly, the pad 91 comprises a central mounting section 101 which is horizontally elongate and offset rearwardly relative to the front pad face 102. The mounting section 101 has a back wall 103 in which is formed a pair of suspension slots 104 as seen in FIG. 15, these slots 104 hook onto the respective arm hooks 99 wherein the lower portion of this back wall 103 then hangs against the support arm 93. No further fasteners are required for securing the lumbar pad 91 to the support arm 93. More particularly, the lumbar pad 91 may be hooked onto the hooks 99 and then pivoted downwardly to the vertical orientation of FIG. 15. While the pad 91 is not restrained and could then pivot forwardly for removal, this removal is prevented once the pad 91 is positioned in abutting relation against the opposing back face of the suspension fabric 25 which fabric 25 prevents pivoting of the pad 91 and removal from the hooks 99.

While it is known to provide a lumbar pad which has a continuous solid construction, the pad 91 of the invention is defined by a plurality of concentric support rings 106-109 which generally extend parallel to each other but are radially spaced apart from each other and are offset in the front-to-back direction. Each adjacent pair of rings is joined together by molded connector webs 111-114.

The innermost support ring 106 is joined at two locations by the webs 111 to the opposite ends of the mounting section 101 such that the vertical sections of this support ring 106 are joined to the mounting section 101 while the remaining horizontal ring sections are completely separated from the mounting section 101.

Since the rings 106-109 and webs 111-114 are all molded together as a one-piece construction, differing support pressures applied by one ring relative to the other is still permitted due to the deformability of the mold material from which the lumbar pad 91 is formed and the different support characteristics provided by the geometry and locations of the webs 111-114. These concentric rings 106-109 are separated from each other along most of their peripheral length so as to allow for greater changes to the contour of the pad face 102 when pressed rearwardly by the back of the chair occupant. As such, each ring can move independently of the others to allow greater variation in pressure distribution to the occupant's back while able to conform to proper ergonomic contours.

The outer three support rings 107-109 are joined one with the other by the webs 112-114. In the upper half of the pad 91, the connector webs 112-114 are located in the upper left and right corners 116. However, in the region of the lower corners 117, no such webs are provided. Rather, the additional webs 119-121 are aligned more centrally within the pad 91 and angled downwardly and outwardly. As such, the specific lumbar configuration illustrated provides more support to the occupant's back in the region of the upper corners 116 since the webs 112-114 cause these upper corner portions 116 to have somewhat greater stiffness than the top portion of the pad 91 located between these corners 116. In this middle area, the horizontal sections of the rings 106-109 are completely separated from each other and have greater relative flexibility.

In the region of the lower corners 117, however, no webs are provided such that these lower corner portions 117 are more flexible with the lower half of the pad 91 being somewhat stiffer in the region of the webs 119-121. By selectively placing the webs 111-114 and 119-121, the response characteristics of the lumbar pad 91 may be selectively designed through use of the test apparatus and process disclosed herein to vary the pressure distribution of the lumbar pad 91 in response to contact with the occupant. Further, the performance characteristics can be varied depending upon the height, width, placement and number of webs 111-114 and 119-121 which may be selectively varied.

With respect to FIG. 15, it is noted that the cross-sectional shape of each of the rings 106-109 is consistent and is generally rectangular. However, the thickness, cross-sectional shape and width of these rings 106-109 also could be varied to vary the response characteristics of this lumbar pad 91.

Figure 11:
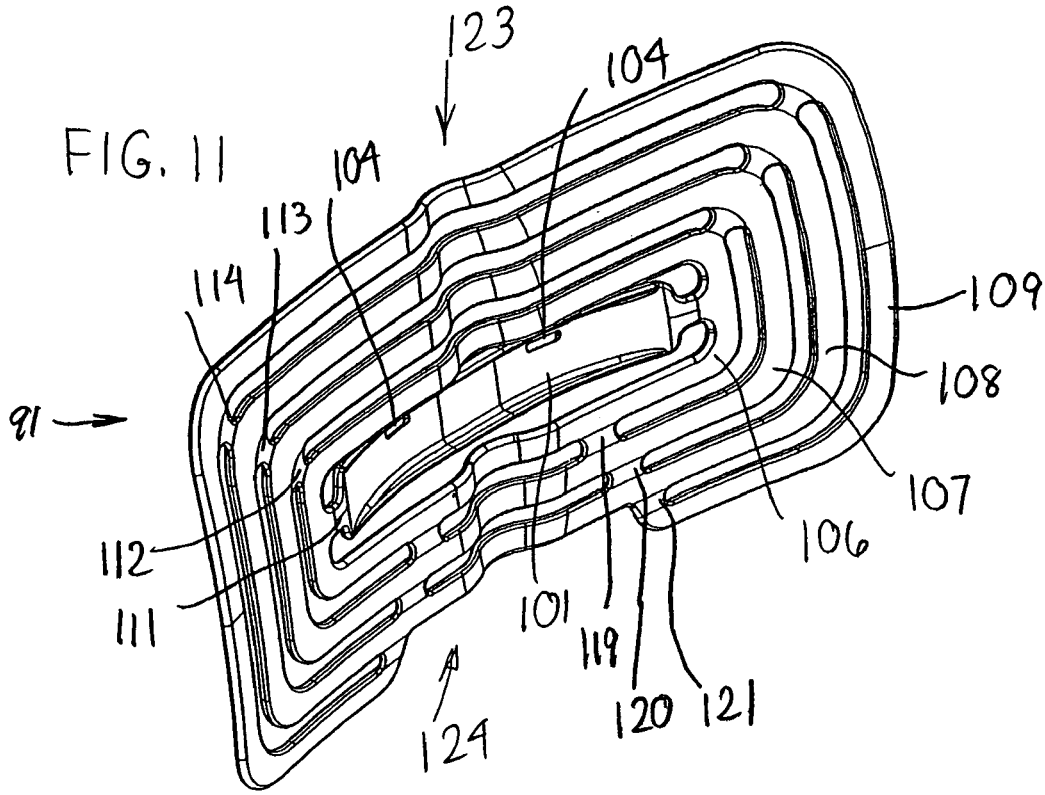
FIG. 11 is an isometric view of the lumbar pad.
Figure 13:
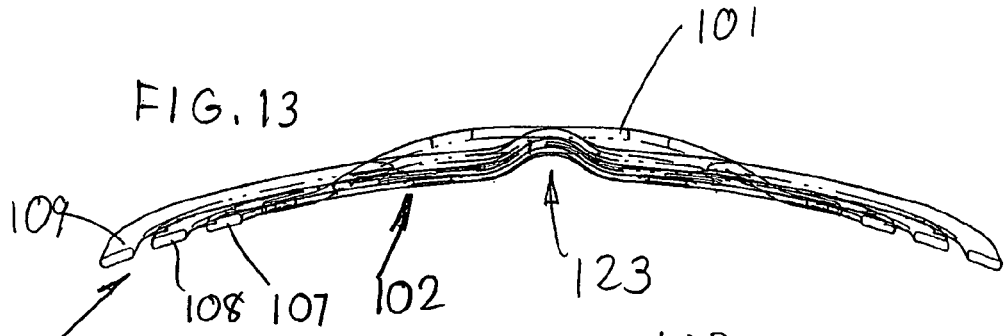
FIG. 13 is a top view of the lumbar pad.
Figure 12:
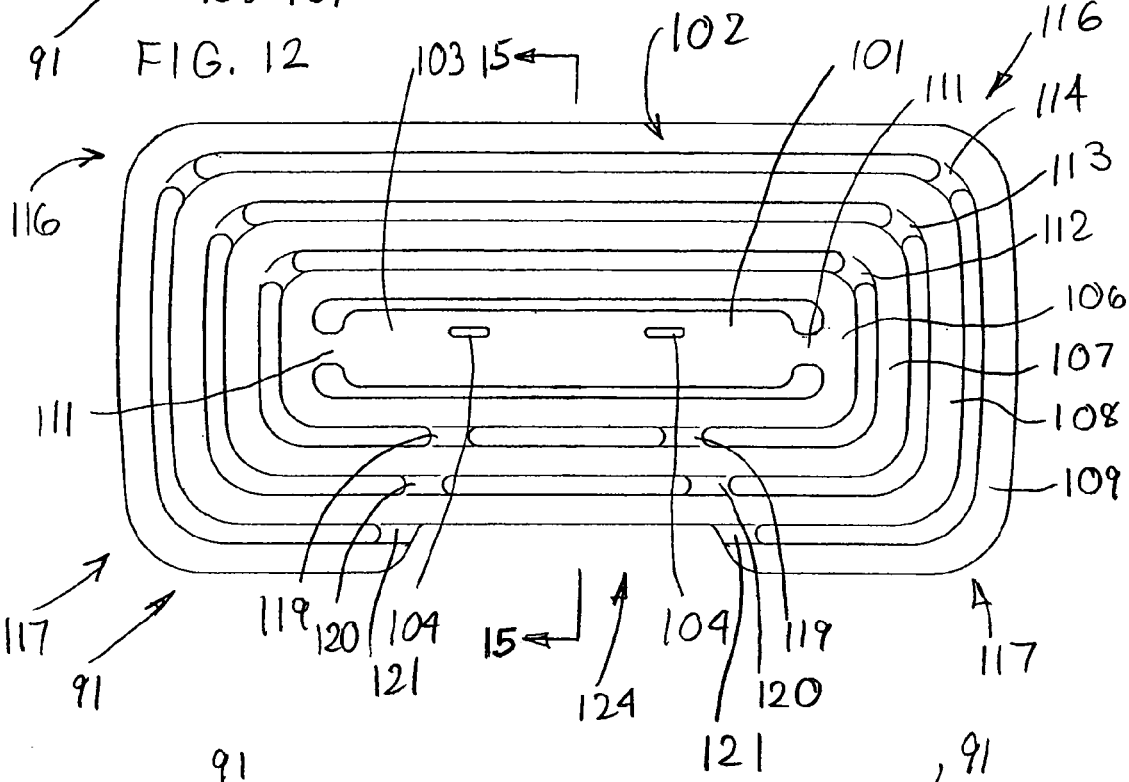
FIG. 12 is a front view of the lumbar pad.
Figure 14:
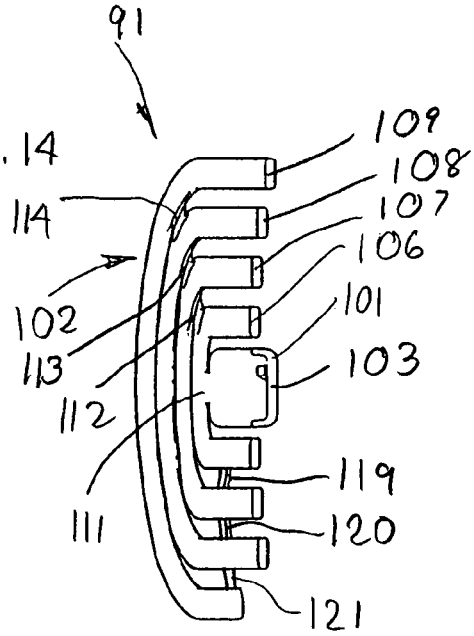
FIG. 14 is a side view of the lumbar pad.

In addition to the foregoing, it is noted that each of the rings 106-109 has a rearwardly curved portion in the region of the vertical center line of the lumbar pad 91 so as to form a central groove 123 (FIGS. 11 and 13). This central groove 123 aligns with the spine of a chair occupant and is provided to minimize and preferably eliminate any physical contact between the lumbar pad 91 and the spinal column of the occupant since pressure on the spinal column is uncomfortable and undesirable.

It will be understood that while the various connector webs 111-114 and 119-121 are generally diagonally aligned, it is possible to provide additional webs in the regions between these locations and that the webs also could be provided in alternate positions, such as staggered from each other, to provide alternative response characteristics to the lumbar pad 91.

Also, the inner support rings 106-108 are formed as endless loops. The outermost ring 109 is substantially similar except that a central portion on the bottom of the lumber pad 91 is omitted. Specifically, the region of the outer ring 109 between the webs 121 is not provided so that the lumber pad 91 has a space or notch 124 (FIGS. 11 and 12) formed therein to provide a clearance space for the pelvic support unit 29 which is disposed adjacent thereto and may be located in this space when the lumbar pad is at its lowest position. In this position, the pelvic pusher 29 and lumbar pad 91 have some overlap.

The arrangement of the support arm 93 provides resilient asymmetric support to this lumbar pad 91 and allows the left and right halves of the lumbar pad 91 to have different performance characteristics. In particular, the left spring half of the arm 93 would provide greater resistance to displacement of the left half of the lumbar pad 91 while the right spring half of arm 93 would provide less resistance to this rearward displacement of the right pad half which thereby provides different support pressures to the pad 91.

To selectively adjust the asymmetric support, the adjustment cranks 94 and 95 (FIG. 9) are provided. These cranks 94 and 95 each have a main shaft 94A and 95A on which a hand piece 94B and 95B is supported on the outer end thereof wherein independent adjustment of the cranks asymmetrically adjusts the support pressures of the lumbar pad halves. In this manner, the chair occupant can readily adjust the asymmetric support provided to the lumbar pad 91 to a level that is most comfortable.

The above-described discussion relates to the preferred lumbar support unit 28. The lumbar pad 91 may also have an alternative configuration as illustrated in FIGS. 16-19.

More particularly, this alternative lumbar pad 200 is substantially similar to the lumbar pad 91 except for differences in the overall shape, web locations and the web construction.

More particularly, this lumbar pad 200 includes a central mounting section 201 which in this instance includes fastener holes 202 to allow for fixed attachment of this lumber pad 200 to an appropriate support arm that would have screw holes rather than the hooks 99. This particular lumbar pad 200 has an hourglass shape defined by larger outer ends and a narrower center area.

The pad 200 is defined by a plurality of concentric support rings 206-209 which are joined in radially separated relation by connector webs 211-214 and additional connector webs 219-221. In this configuration, the innermost ring 206 is connected to the central section 201 by the pair of connector webs 211 that are formed substantially similar to the webs 111 described above. Additionally, the outer support rings 207-209 are supported by the connector webs 212-214, which webs 212-214 extend diagonally outwardly at the upper pad corners 216.

The pad 200 differs in that the connector webs 219-221 are located diagonally adjacent to each other at the lower corners 217 of the pad 200 which therefore provides response characteristics at the upper corners 216 and lower corners 217 that are substantially similar. This also provides greater flexibility in the spinal area of the bottom half of the pad 200 since the connector webs 219-221 are shifted farther outwardly as compared to the connector webs 119-121.

Further, the webs 212-214 and 219-221 differ in that they are formed as rearwardly curving shapes. Due to the resiliency of the mold material, these webs 212-214 function more as J-shaped springs as opposed to the flatter webs 112-114 and 119-121. This allows radially adjacent rings to move more independently of each other since there is more length to the webs 212-214 and 219-221 as compared to the flatter webs described above which therefore provides more resiliency.

Like the pad 91, this pad 200 also includes a central clearance groove 223 in the area of the spinal column to avoid contact with this part of the occupant's body.

To affect the design and development of the lumbar pads 91 or 200, a test chair 300 (FIG. 20) was developed to test the actual preferences of a group of test subjects. This test chair 300 includes a test rig 301 mounted to the chair 300 adjacent to the lumbar region of a seated occupant. The test rig 301 generally serves to apply variable pressures over multiple contact locations to develop a data profile of the preferred pressures over this entire contact area for multiple test subjects.

Generally as to the test chair 300, this chair includes a conventional base 303, a tilt control mechanism 304 and a modified seat-back assembly 305 mounted to the tilt control 304. The tilt control mechanism 304 includes a pair of generally L-shaped uprights 307 which have their forward ends 308 pivotally connected to a tilt control body 309 to permit downward or rearward tilting of the seat-back arrangement 305. The uprights 307 project rearwardly and upwardly and are joined together by upper and lower cross rails 310 and 311.

The seat-back arrangement 305 includes a conventional cushion seat 312 and a modified back cushion 314 which is supported on the uprights 307 by a mounting bracket 315. The chair back 314 is cushioned and is similar to a conventional back except that the vertical dimension thereof is substantially reduced or cut off so that it is only adapted to contact and support the upper thoracic region of the test subject when seated on the chair 300. As a result of the reduced vertical length of the chair back 314, an open test region or space 316 is defined vertically between the rear edge 317 (FIG. 21) of the seat 312 and the lowermost edge 318 of the chair back 314. This test region 316 generally is defined in the lumbar region of a typical occupant in the chair serving as the test subject.

Within this test region 316, the test rig 301 is mounted to the uprights 307 as described in further detail herein wherein the test rig 301 is adapted to selectively contact the lumbar region of the test subject for determining the support preferences of a plurality of such test subjects and then merging this data to design and develop the lumbar pad 91.

It is noted that the testing process and the apparatus are particularly designed for evaluating the support preferences of the lumbar region of each subject's back. However, this test rig 301 also could be located and adapted for engagement with other areas of the occupant's body such as the thoracic region.

More particularly as to the test rig 301, the rig 301 comprises a plurality and preferably four elongate support rods 320 which have their forward ends 321 rigidly affixed to the uprights 307 so that the guide rods 320 project rearwardly from the uprights 307 in cantilevered relation. The opposite rearward, free ends of the guide rods 320 have a rectangular backing plate 322 rigidly affixed thereto. This backing plate 322 has an exterior rectangular shape but is cut-out from the center thereof to define a generally rectangular window 323 which opens horizontally therethrough.

Figure 20:
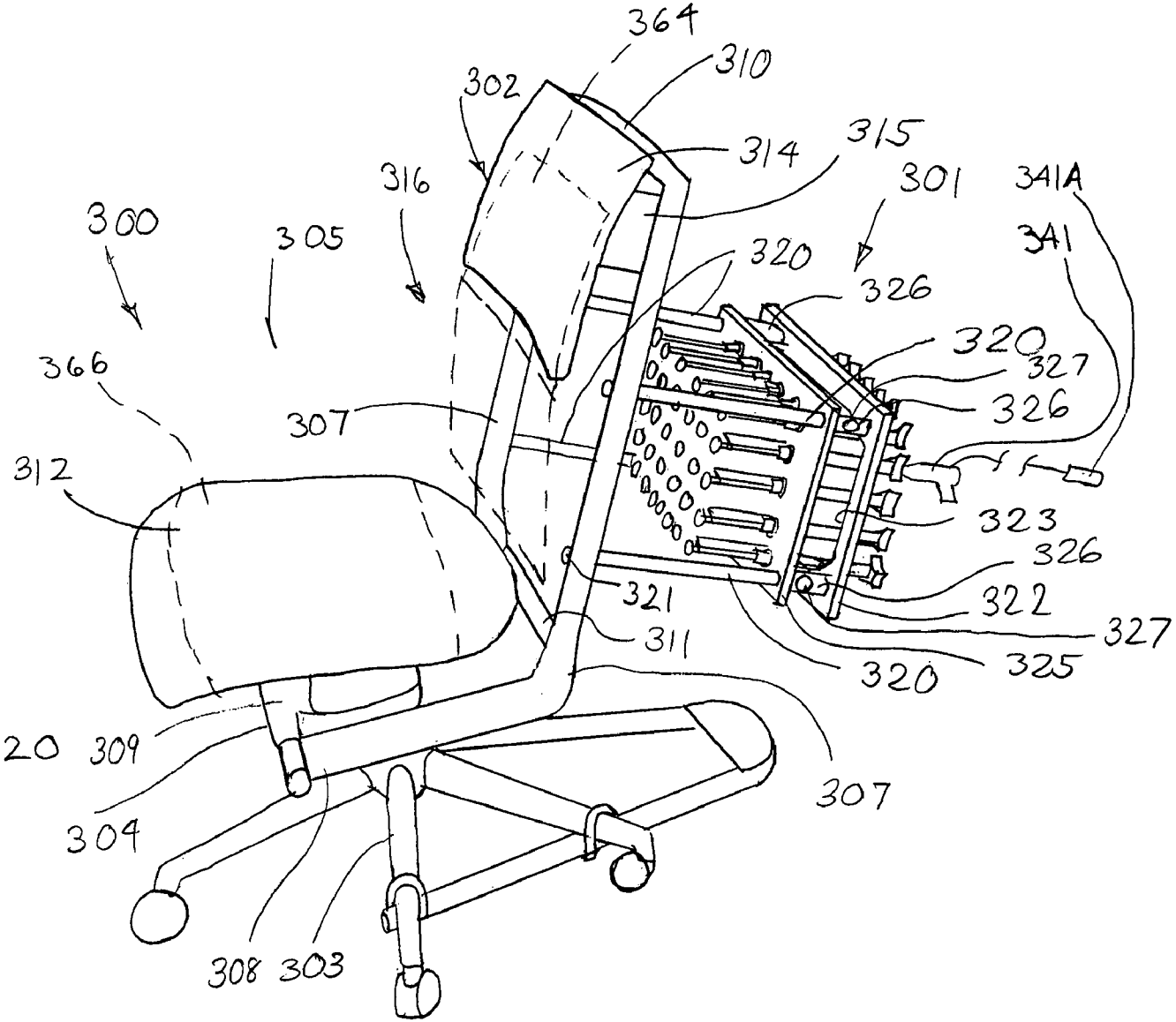
FIG. 20 is a perspective view of a test chair having a test rig mounted thereto for determining the support preferences of an occupant.

The test rig 301 further includes a rectangular slide plate or support plate 325 (FIGS. 20 and 21) which includes circular bores at the four corners thereof through which the guide rods 320 are slidably received. The slide plate 325 also includes cylindrical mounting collars 326 which are mounted at each corner and project rearwardly so as to slidably receive the guide rods 320 entirely therethrough. These mounting collars 326 include a clamp handle 327 which may be driven radially inwardly to contact the guide rod 320 much like a set screw wherein actuation of the handle 327 serves to fixedly secure the slide plate 325 at any location along the longitudinal length of the guide rods 320. For example, the slide plate 325 may be positioned rearwardly as seen in FIG. 20 in this inactive position and may be slid forwardly to the position illustrated in FIG. 21 or FIG. 23 in an active test position. In this manner, the slide plate 325 may be slid forwardly and rearwardly along the guide rods 320 and then locked in a selected position by the wheel 327.

Figure 21:
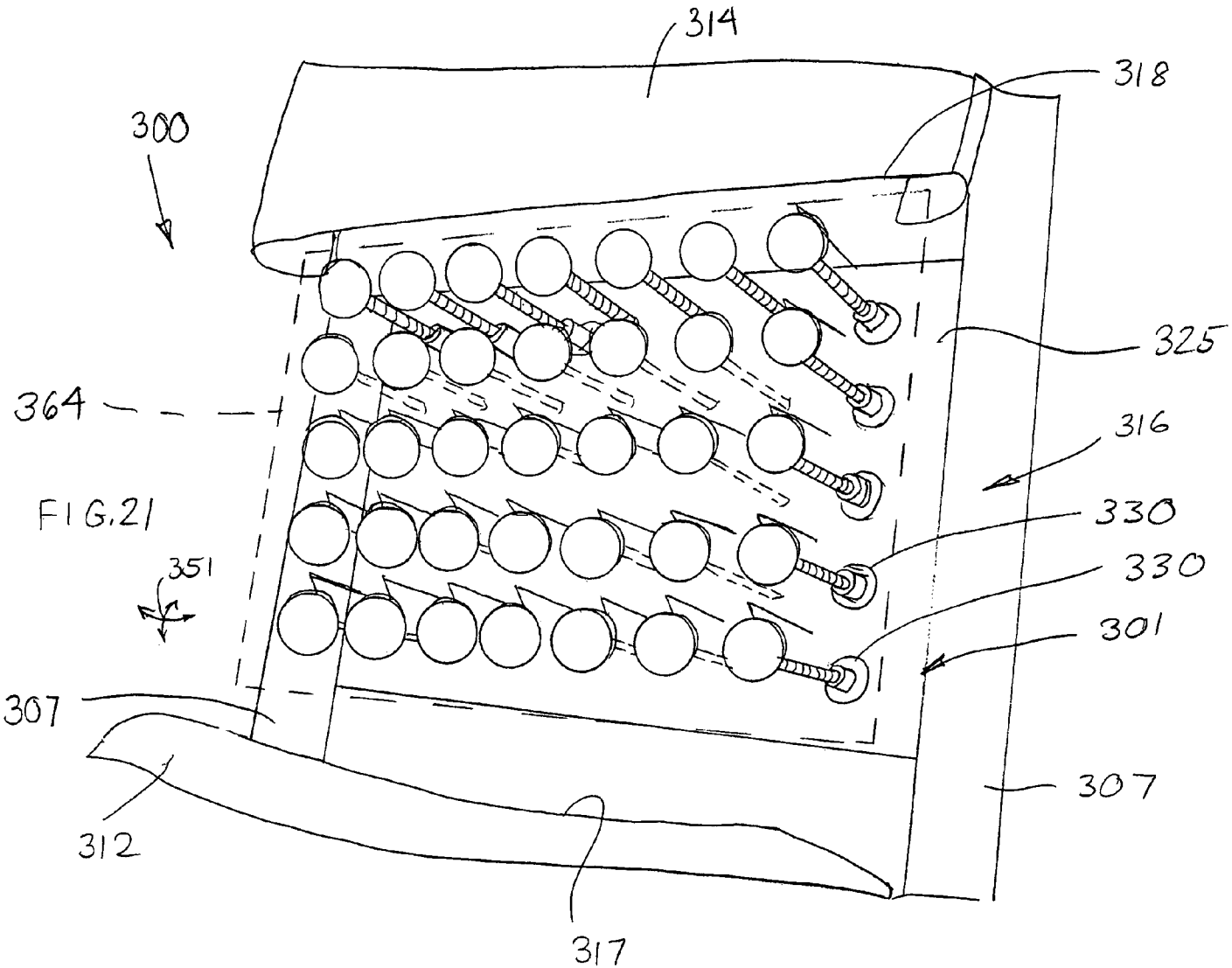
FIG. 21 is an enlarged front prospective view of the test rig mounted to the chair.

To develop and acquire data associated with the preferred support pressures being applied to a test subject's lumbar region and if desired to indicate the contour of the user's back, the slide plate 325 is provided with an array of adjustable testers or diodes 330 (FIGS. 21 and 22) which are mounted in the preferred embodiment in five rows and seven columns in a rectangular test pattern (as seen in FIG. 21). As such, preferably thirty five (35) such testers 330 are mounted to the slide plate 325 so as to substantially cover the test area 316 and provide individual data locations for deriving data throughout the entire test region 316.

The tester 330 is a multi-component telescoping assembly having a plunger-like contact pad 332 on the end thereof. The individual testers 330 are moveably engaged with the slidable support plate 325.

In particular, the support plate 325 includes an array of threaded apertures 333 wherein each such aperture 333 is adapted to support a corresponding one of the testers 330. Each tester 330 includes a threaded support bushing 334 that has an outer surface 335 that is threaded so as to be threadedly engaged with the corresponding inside face of the plate aperture 333 and be stationarily mounted on the slide plate 325 and move in unison therewith.

The bushing 335 also has a threaded interior bore 336 which opens horizontally therethrough, and the tester 330 further comprises a horizontally elongate adjustment shaft 337 which includes outer circumferential threads 338 thereon. These threads 338 engage the interior surface 336 of the support bushing 334 such that rotation of the adjustment shaft 337 effects longitudinal displacement of the tester 330 relative to the forwardly or rearwardly support plate 325.

The rearward end of the shaft 337 includes a hand knob 339 for manual rotation of the shaft 337 and also includes a drive socket 340 on the rear end thereof which is adapted to be engaged by a driving machine 341 (FIG. 20) such as a screw gun 341 or the like. This screw gun 341 is connected to a manual switch 341A that is operated by the test subject. The socket 340 is accessible through the window 323 of the backing plate 322 as seen in FIG. 20. Therefore, as the test subject presses the switch to actuate the drive mechanism, the shaft 337 will either be rotated in a clockwise direction when viewed from the right end of FIG. 22 so as to shift the shaft 337 forwardly towards the subject or counter-clockwise which will move the shaft 337 rearwardly away from the subject.

The adjustment shaft 337 includes a hollow open front end 342 which hollow end 342 opens rearwardly into an interior chamber or blind bore of the shaft 337 as indicated diagrammatically by phantom reference line 343. This interior chamber 343 includes a coil spring therein which generally serves to axially bias the contact pad 332 in a forward direction.

More particularly, the tester 330 includes a plunger rod 345 which is slideably fitted into the shaft bore through the open end 342. The innermost end of this plunger rod 345 is enclosed within the chamber 343 of the adjustment shaft 337 and is normally biased forwardly by the internal spring, which spring also permits inward retraction of the plunger rod 345 as described in further detail hereinafter. The particular spring used herein preferably has a predetermined spring rate which preferably is two (2) pounds per inch. Since the actual displacement of the plunger rod 345 during retraction thereof is measured, this spring rate may be used to calculate the actual spring load being applied to the rod 345 during the testing procedure.

Figure 22:
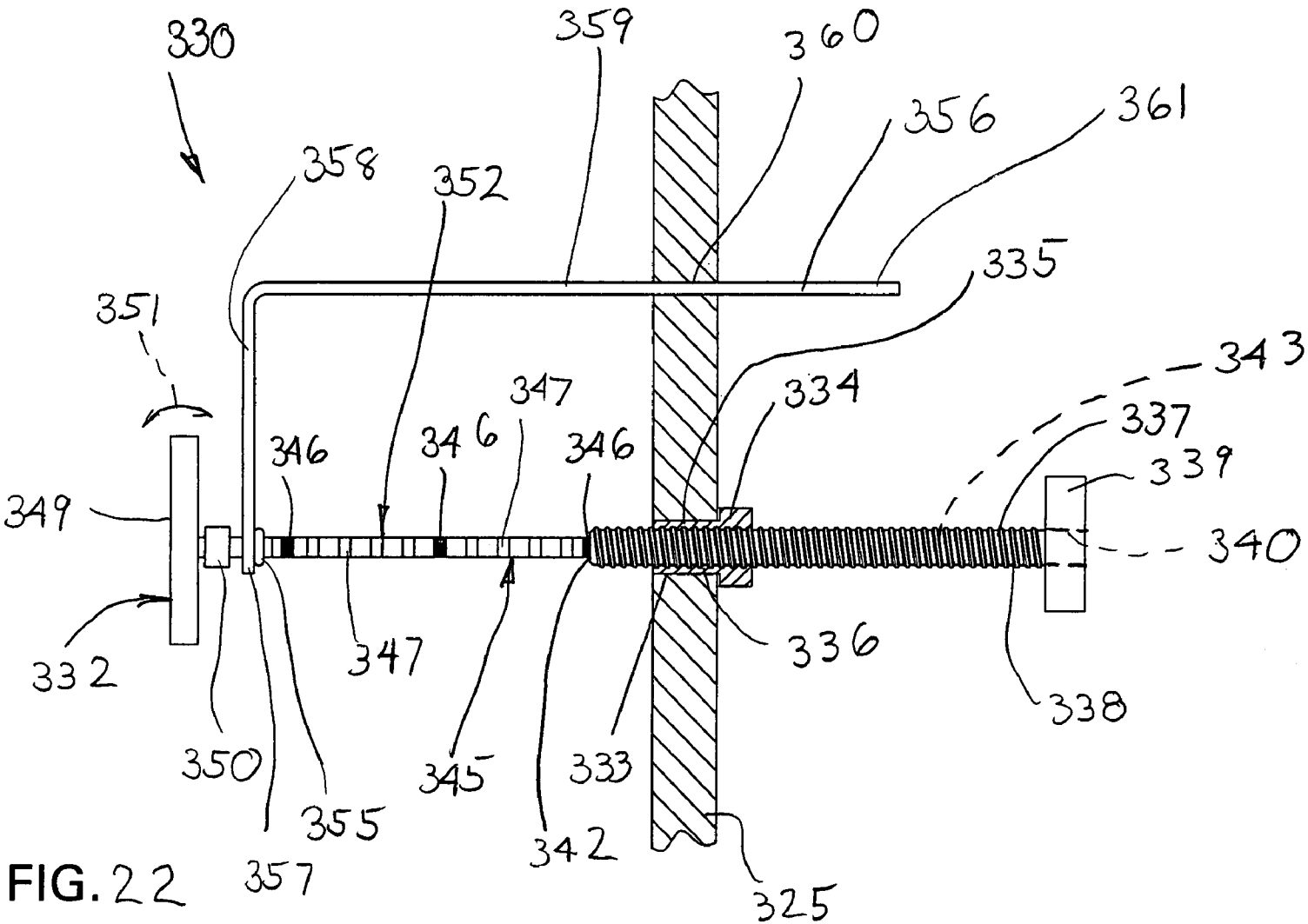
FIG. 22 is a side cross-sectional view of one telescoping tester device.

The outermost end of the rod 345 includes the aforementioned contact pad 332 thereon. The contact pad 332 has a circular front face 349 and is connected to the end of the rod 345 by a swivel connector 350 which allows the front face 349 to tilt several in any of the forward or rearward directions and the sideward directions as generally indicated by reference arrow 351 (FIGS. 21 and 22).

Along the length of the plunger rod 345, a plurality of equi-distant surface indicators 352 are provided to indicate the relative axial displacement of the rod 345 into the adjustment shaft 337. More particularly, a plurality of solid indicator bands 346 are provided at a relatively large distance apart from each other. Four (4) additional intermediate bands 347 are provided between the main indicator bands 346 to incrementally divide the space between these main bands 346. Each of the bands is about 0.100 inches in axial length and are spaced apart from each other by about 0.100 inches. As such, a relative axial displacement of the contact pad 332 rearwardly relative to the shaft 337 may be readily calculated by determining how many of the original indicator rings 346 or 347 are hidden within this shaft 337 or vice-versa, the number of exposed rings 346 or 347 may be determined which will give an accurate measurement of the length of the exposed portion of the plunger rod 345 as well as the hidden portion of the plunger rod 345. By determining this relative axial displacement of each rod 345, the overall spring load acting axially forwardly along the rod 345 and the contact pad 332 may be calculated. Specifically, the displacement distance of the plunger rod 345 indicates the compression of the interior spring which distance and compression along with the spring rate provides a relative spring force acting on the rod 345. Thus, the indicator bands 346 and 347 allow for mathematical determination of the axial displacement of the contact pad 332 as well as the spring force acting thereon.

It is noted that the contact pad 332 for each of the testers 330 has a relatively large diameter of about 1.5 inches and a substantially smaller spacing between adjacent pads 332.

Typically, the contact pad 332 is displaced during the testing procedure when a test subject is seated within the chair 300. However, the measurements are best determined after the test subject leaves the chair 300 so as to expose the test rig 301 and allow for visual determination of the magnitude of displacement. In this regard, each tester 330 preferably includes a marking arrangement to mark the relative retraction amount of the plunger rod 345 during the test. This is accomplished by an elastomeric O-ring 355 (FIG. 22) which serves as a marker. This O-ring marker 355 is displaceable axially along the plunger rod 345. In this regard, a pull wire 356 is provided to pull the marker 355 to a desired location as will be described in further detail herein.

The pull wire 356 includes a circular eyelet 357 that surrounds the rod 345 and abuts axially against the side surface of the marker 355. This eyelet 357 is connected to a radial leg 358 of the pullwire 356 which in turn connects to an axial leg 359 which extends rearwardly through a corresponding bore 360 in the slide plate 325. A rearward exposed end portion of the axial leg 359 serves as a pull handle 361 as seen in FIG. 22. Therefore, by pulling on the pull wire 356, the O-ring 355 may be displaced rearwardly along the length of the plunger rod 345.

Figure 23:
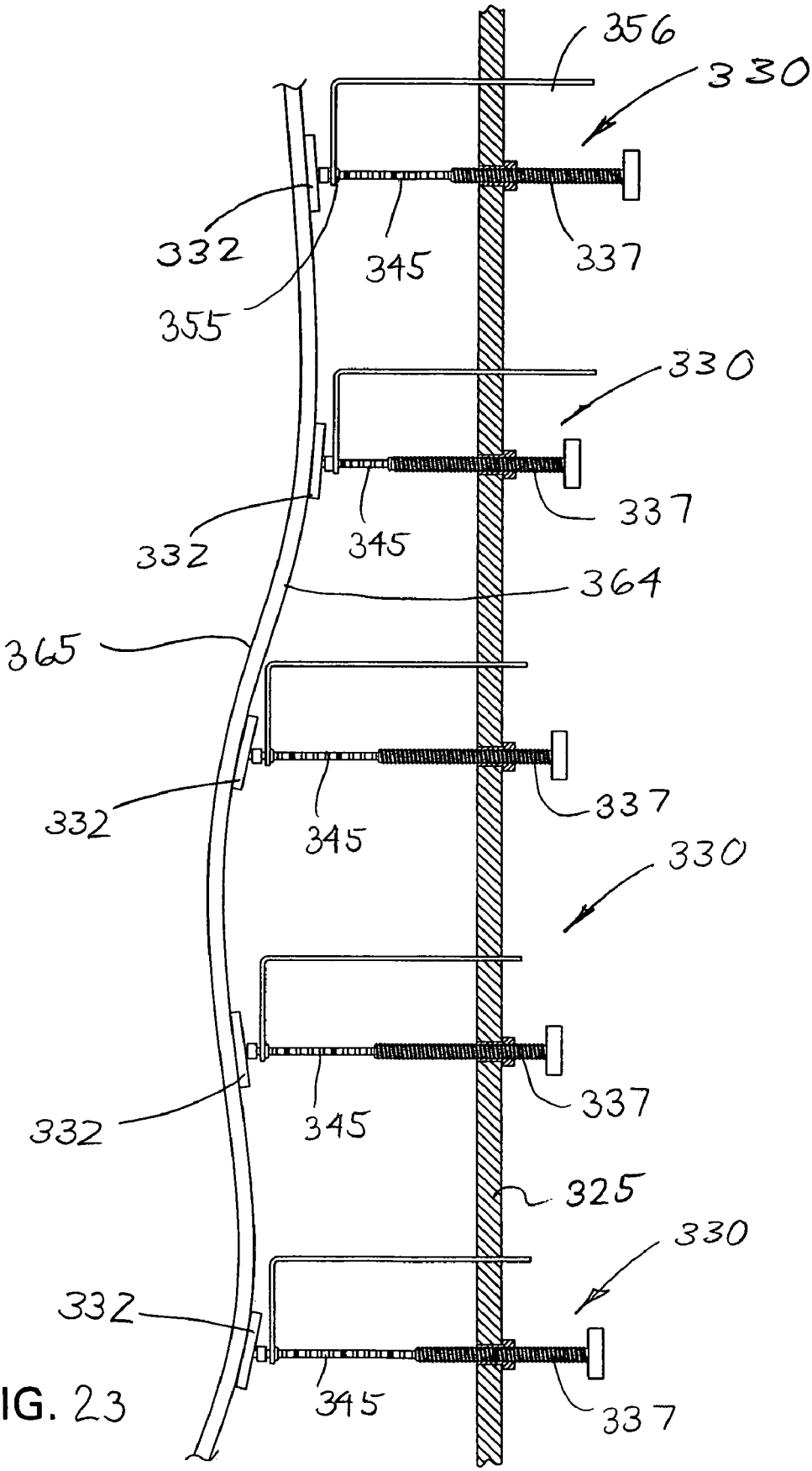
FIG. 23 is a diagrammatic side view illustrating a vertical column of testers disposed adjacent the lumbar region of the occupant.

As generally described above, each tester 330 provides an indication of the location of the contact pad 332 as well as the spring pressure being applied thereby to the test subject. To further evaluate the contact pressures being applied to the chair occupant, an additional pressure determination system is provided in conjunction with the testers 330. More particularly, as generally illustrated in FIGS. 20, 21 and 23, an FSA pressure mapping system is provided over the front face of the chair back in overlying relation with the testers 330. This pressure mapping system includes a pressure mat 364 which is generally rectangular in shape and overlies about three-quarters of the vertical height of the chair back. This pressure map is dimensioned so as to wrap around the opposite sides of the chair back and is secured in place by Velcro straps or other attachment methods. Referring to FIG. 23, the general contour of the lumbar region of an occupant or test subject 365 is illustrated wherein the flexible pressure mat 364 has a contour which corresponds to the contour of the test subject 365.

The pressure mapping system is a commercially available system sold by Verg Technologies of Winnipeg, Manitoba, Canada. The pressure mat 364 used on the back is a high-resolution rectangular mat that preferably collects 1,024 contact pressure data points (32 sensors by 32 sensors) per frame. The centers of these pressure map centers are approximately three millimeters apart wherein the pressure mapping system and the data collection equipment is set to collect ten frames per second. Preferably during the testing process, the data is collected over periods of several seconds for each adjustment of a tester 330. This pressure mapping system was used to further determine the pressures acting upon the occupant's back 365. Additionally, an additional pressure mat 366 was provided on the seat which mat 366 wrapped over the opposite side edges of the seat 312 and was also secured in place thereon. This pressure mat 366 is a lower resolution mat which primarily functions to determine the physical location of the seat of the occupant 365 during the test procedure.

More particularly as to the actual use of the testers 330, the test process generally involves first positioning the test rig 301 to the test position illustrated in FIG. 21.

Figure 24:
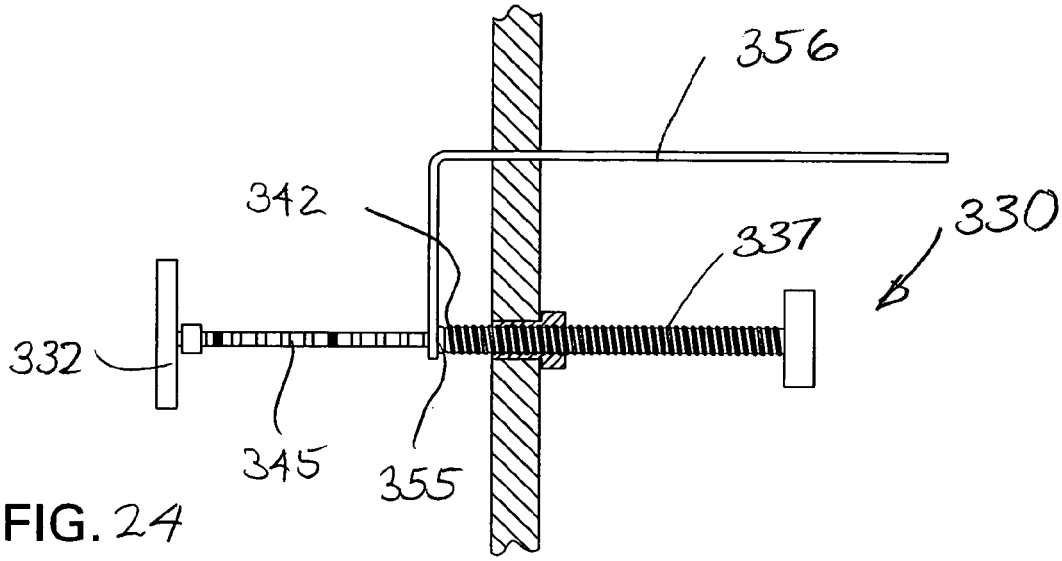
FIG. 24 is the side view of the tester with a marker retracted rearwardly.

Generally, during a test run, the test subject is seated within the chair 300 wherein the thirty five (35) testers 330 are adjusted in their position and their contact pressure until reaching a point where the subject is of the subjective opinion that this provides a most comfortable quantity of pressure on their lumbar region. Each one of the thirty five (35) testers 330 is adjusted individually so that the distribution of comfort pressures being applied by each one individually may vary from one tester 330 to the other. Typically at the beginning of a run, every other tester 330 is in the retracted position of FIGS. 22 and 24 wherein the adjustment shaft 337 is in a rearwardly displaced position. The other remaining testers 330 are disposed in a forward contact position by having the adjustment shaft 337 displaced to the forward position of FIG. 27.

Figure 27:
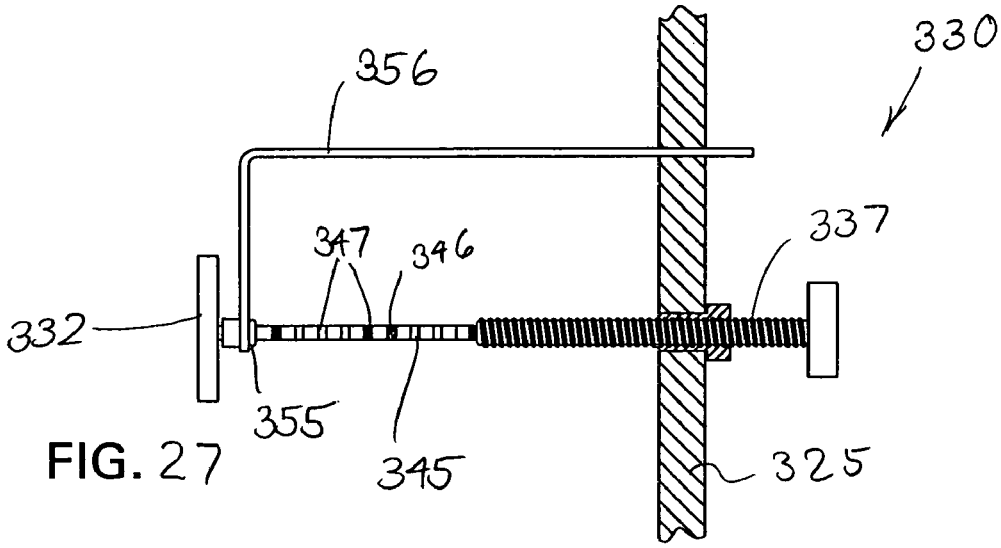
FIG. 27 illustrates the tester with an adjustment shaft driven forwardly and the contact pad in the fully extended position.

At the beginning of a test run, the marker 355 is disposed in the forwardmost position as seen in FIGS. 22 and 27 with the associated pull rod 356 in a corresponding forward position. As diagrammatically illustrated by FIG. 24, however, the pull rod 356 also is completely displaced rearwardly to pull the marker 355 rearwardly against the outer opening 342 of the shaft 337.

Figure 25:
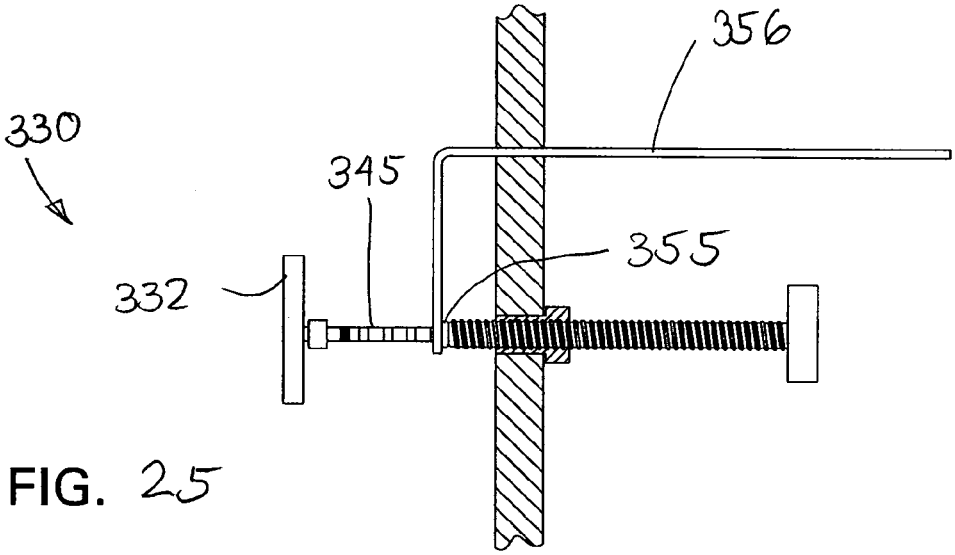
FIG. 25 illustrates the tester of FIG. 24 in the retracted position with the marker displaced rearwardly by a pullwire.

FIG. 25 diagrammatically illustrates the contact pad assembly namely the contact pad 332 and plunger rod 345 in a retracted position which may be the result of being pressed rearwardly by the occupant's back 365. If this is the final position for the contact pad 332 and the support pressure applied thereby is deemed comfortable by the occupant 365, at the end of the test run, the pullwire 356 would be pulled rearwardly to draw the marker 355 to its farmost rear position. Once the occupant leaves the seat, the internal spring of the shaft 337 drives the plunger rod 345 forwardly as seen in FIG. 26 with the contact pad 332 being disposed in its normal forwardly extended position. Due to the gripping of the marker 355 on the rod 345, this marker 355 is carried in the position set in FIG. 25 so as to continue to indicate the amount of exposure on the rod 345 during the test. By counting the number of bands of indicators 346 and 347, the magnitude of displacement of the rod 345 may be calculated as well as the spring force being applied thereby due to the magnitude of compression of the internal spring.

Figure 28:
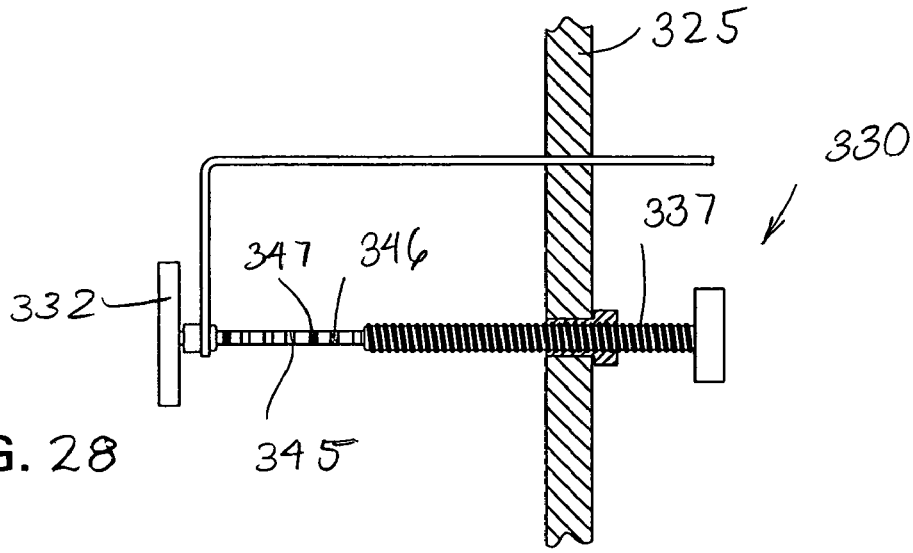
FIG. 28 illustrates the contact pad retracted rearwardly to a selected position.
Figure 29:
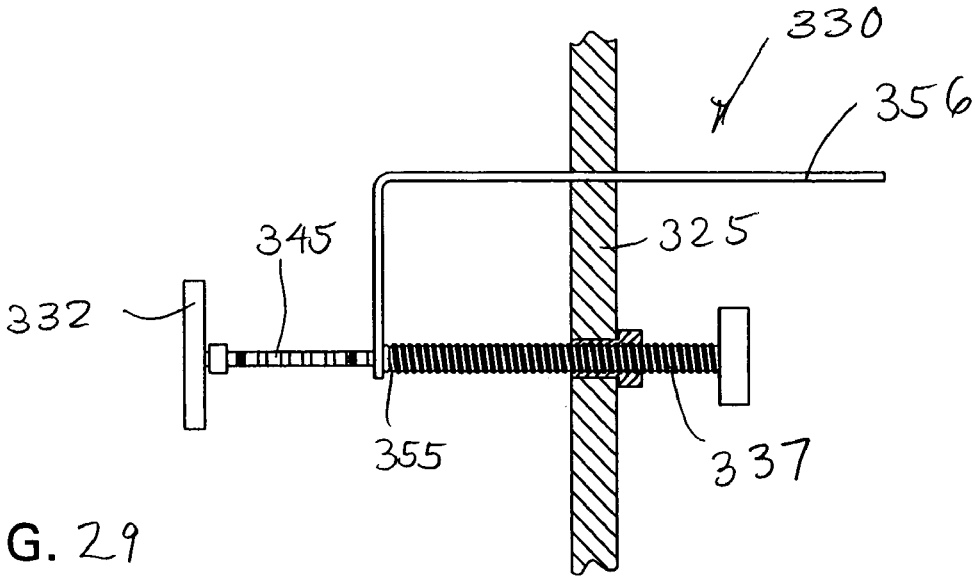
FIG. 29 illustrates the marker pulled to a marking position.

More typically during the test, a test subject may prefer an increased amount of support pressure being applied to the lumbar region which support pressure may vary. This is permitted as depicted in FIG. 27 since the adjustment shaft 337 may be driven forwardly by the screwdrive 341. This thereby displaces the entire plunger assembly to a further extended position. As seen in FIG. 28, the contact pad 332 may be in the position illustrated therein. Since the shaft 337 has been displaced forwardly, the spring resistance being provided thereby on the plunger 345 is greater. FIG. 29 illustrates pullwire 356 being pulled rearwardly to set the marker 355 for subsequent measurement after the test subject leaves the chair 300.

Referring now to FIG. 23, a vertical column of the testers 330 is diagrammatically illustrated with the adjustment shafts 337 being disposed at a variety of locations and the amount of extension of the plunger rods 345 being varied from one to the other. This thereby indicates the different support pressures that may be generated depending upon the relative positions of the adjustment shafts 337 and the contact pads 332. Notably, the contact pads 332 may swivel so as to conform generally to the contour of the occupant's lumbar region 365. FIG. 23 generally illustrates the various markers 355 in their initial position. Just prior to termination of the test, when the subject indicates that the various testers 330 are at a preferred comfort level, the pullwires 356 would then be pulled rearwardly to set the markers 355 against the forward free end of the shaft 337 such as depicted in FIGS. 25 and 29. Once set and after the occupant leaves the chair, the plungers 345 would return to their normal position with the marker 355 still indicating the amount of retraction thereof as depicted in FIG. 26.

By determining this amount of retraction, the overall contact pressure may be determined based on the retraction measurement and the spring rate. Additionally, the relative positions of the contact pads 332 may be used to determine and evaluate the contour of the lumbar region.

During a testing procedure, three (3) runs are conducted with the chair back in a normal upright position as seen in FIG. 20.

Generally in a typical test run, the individual testers 330 were selectively adjusted in response to the occupant. During a first run, the testers 330 were located alternatingly in a forward position such as that illustrated in FIG. 27 and a rearward position such as that illustrated in FIG. 24. Then, the adjustment shafts 337 were all individually adjusted to a preferred comfort level. At the end, the pullwires 356 are then pulled rearwardly to set the markers 355, after which the occupant leaves the chair. Measurements are then taken to determine the contact support pressure. In addition to this manual determination of the contact pressure, equivalent pressures were automatically measured by the pressure mat 364.

Additionally, at the beginning of the process, the test subject manually presses on the mat at the lumbar location of their chair back to set a reference location. The pressure mat then was set to collect one thousand twenty four (1,024) contact pressure data points per frame with ten frames of data collected per second. After each adjustment of a tester, data was collected for about five seconds resulting in a total of about fifty frames of pressure sensor readings. During each run there was an initial collection period and a final collection period and on average, about five (5) total adjustments were made of the testers 330 so as to result in about seven (7) data collection periods for a particular subject during a single run. Preferably, three (3) runs were conducted in the upright position with the first run having the testers displaced forwardly or rearwardly in alternating relation and then this arrangement was reversed in the next run. These first two runs were conducted in an effort to obtain convergence of the comfort pressures and verify the data from the first run with the data derived from the second run. A third run was then conducted to determine the repeatability of the comfort pressures.

An additional test run was conducted with the chair in a reclined position. Once all of this data was collected for multiple test subjects, a map of the pressure characteristics of each person was developed and this information was then used to design the above described lumbar pads 91 and 200 in a manner which provided comfort to the greatest range of chair occupants. In this regard, it was determined that the majority of occupants preferred an asymmetrical pressure distribution in the lumbar region within a desired range, thus confirming the desirability of the asymmetrical adjustment structure described above relative to the pads 91 and 200.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A method for designing a body support member of a body-supporting furniture component which said support member has an enlarged support surface which supports a corresponding surface area of the body of the furniture occupant, the method comprising the steps of:

providing a test unit adapted to support a test occupant in a use position, said test unit including an array of testers positioned one next to the other along transverse first and second axes to overlie a test surface area of the body of the test occupant, said testers having a contact portion positioned for contact with said test surface area on the body of the test occupant wherein said contact portions of said testers of said array are positioned over said test surface area;

positioning a said test occupant in said use position on said test unit with said test surface area of said test occupant's body positioned over said array of testers for contact therewith;

adjusting the contact portions of said testers to a desired position contacting said test surface area;

determining a contact pressure between each said contact portion and said test surface area to develop a pressure map of said contact pressures over said array of said testers; and designing the support member for the furniture component in accord with said pressure map to provide optimized, comfortable support between said support member and the surface area of said occupant of said furniture component which corresponds to said test surface area of said test occupant.

2. The method according to claim 1, wherein said support member is a lumbar support pad configured to support a lumbar portion of a back of said furniture occupant of said furniture component.

3. The method according to claim 2, wherein said lumbar support pad comprises a plurality of elongate support rings joined together by transverse connector webs wherein said support rings and said connector webs are deformable, said method including the step of configuring said support rings and said connector webs and the deflectability thereof in accord with said pressure map to provide optimized support pressures over said support surface of said occupant.

4. The method according to claim 3, wherein said lumbar pad is supported on said furniture component by a deflectable arm, said arm providing asymmetric support to said lumbar pad wherein said method includes the step of varying said asymmetric support to said lumbar pad.

5. The method according to claim 1, further including the steps of repositioning said testers along a third axis, which is oriented transverse to said first and second axes and extend toward and away from test surface area, to vary the relative position of said contact portion of each said tester relative to said contact portion of adjacent ones of said testers.

6. The method according to claim 5, wherein said adjusting of said contact portions is performed by said test occupant.

7. The method according to claim 1, wherein said adjusting step is performed by said test occupant by individually repositioning said respective contact portions of said testers of said array directly by said test occupant to a subjectively determined preferred position.

8. The method according to claim 7, wherein said determining of said contact pressure is determined by calculating the displacement of said contact portion of each said tester from an initial unadjusted position to an adjusted position to which said contact portion is displaced by said test occupant.

9. The method according to claim 7, wherein said determining step includes the step of positioning a pressure map between said contact portion and said test surface area which said pressure mat indicates the contact pressure between said contact portion and indicates a pressure reading for each said contact portion and the relative position for each said reading.

10. A test rig for obtaining test data identifying optimum contact pressures between a support member and an opposing contact area on a body of an occupant of the test rig, said test rig comprising:

a frame having seat and back sections for supporting the seat and back of the test occupant; and an array of testers mounted on said frame in side by side relation wherein said array extends over a test area extending across first and second transverse axes and said testers project toward said test occupant in the direction of a third axis extending transversely relative to said first and second axes, each said tester comprising a tester body mounted to said frame, an adjustment shaft projecting in the direction of said third axis towards the test occupant, and a contact portion disposed on a free end of said adjustment shaft which defines a contact surface positioned for contact against a test area of said test occupant, said contact portion and said adjustment shaft being displaceable together to a preferred contact position in contact with a test surface area of the body of said test occupant wherein the adjusted position of said contact portion and said adjustment shaft are controlled by said test occupant to provide a preferred contact pressure between said tester and said test surface area, each said tester including an indicator to identify a relative position of said contact portion and said adjustment position and indicate the contact pressure between each of said contact portions and said test surface area.

11. The test array according to claim 10, wherein said adjustment shaft includes axially spaced indicators indicating displacement of said adjustment shaft between an initial position and said adjusted position.

12. The test rig according to claim 11, wherein said adjustment shaft is biased resiliently by a biasing member towards said test occupant and said contact pressure is determined by calculating the displacement of said adjustment shaft relative to resilient biasing characteristics of the said biasing member.

13. The test rig according to claim 12, wherein a drive unit is provided to drivingly adjust the relative position of each said adjustment shaft wherein said drive unit is controlled by said test occupant to displace said contact portion to a position that provides a subjectively optimized contact pressure for each said contact portion.

14. The test rig according to claim 10, wherein said test rig includes a pressure mat overlying said array of said testers to electronically determine contact pressure between said testers and said test surface area.

15. A method for designing a support pad for a furniture component positioned to physically support a component user, said method comprising the steps:

providing a test rig resembling said furniture component;

providing said test rig with an array of testers adapted to contact a test area on the body of a test occupant;

adjusting the contact pressure between each of said testers of said array over said test surface area of said test occupant to subjectively determine the optimum contact pressure between each said tester and said test occupant;

determining the contact pressure between each said tester and said test surface area and determining a pressure distribution of said optimum contact pressures; and designing said body support member for said furniture component in accord with said pressure distribution to provide optimum contact pressures for a plurality of different furniture occupants.

16. The method according to claim 15, wherein a plurality of test occupants are evaluated in said test rig to determine optimum contact pressures for said plurality of test occupants to identify a range of optimum contact pressures for said plurality of said test occupants.

17. The method according to claim 16, wherein the optimum contact pressures for said testers are determined for each said test occupant to collect test data over a plurality of test periods.

18. The method according to claim 16, wherein said testers are arranged in said array over transverse first and second axes extending across said test surface area, said testers projecting in the direction of a third axis extending transverse to said first and second axes.

19. The method according to claim 15, wherein said test surface area is defined over a lumbar region of a back of the body of said test occupant.

20. The method according to claim 15, wherein said support member has adjustable support characteristics transversely across a width of said support member and vertically across the height of said support member so as to support an enlarged surface area of said furniture occupant, said support characteristics of said support member being varied in the first and second directions in accord with said test results.

* * * * *